US006029582A

United States Patent [19]

Ogilvie, Jr. et al.

[11] Patent Number: 6,029,582

[45] Date of Patent: Feb. 29, 2000

[54] FORCE RESISTING CORRUGATED ASSEMBLY

[76] Inventors: Morgan O. Ogilvie, Jr., 151 Fairmount Dr., Birmington, Ala. 35213; Paul M. Whatley, 3805 Jackson Blvd., Birmingham, Ala. 35213; Michael W. Olvey, 4790 Gordon St., Fairburn, Ga. 30213

[21] Appl. No.: 09/271,774

[22] Filed: Mar. 18, 1999

[51] Int. Cl.[7] ..... B65D 19/00

[52] U.S. Cl. ..... 108/51.3; 108/165

[58] Field of Search ..... 108/51.3, 165, 108/51.11

[56] References Cited

U.S. PATENT DOCUMENTS

| | | | |
|---|---|---|---|
| 2,951,669 | 9/1960 | Davidson | 108/51.3 |
| 3,308,772 | 3/1967 | Thomas, Jr. | 108/51.3 |
| 3,434,434 | 3/1969 | Horton, Jr. | 108/51.3 |
| 4,228,744 | 10/1980 | Moore . | |
| 4,759,295 | 7/1988 | Nilsen et al. | 108/51.3 |
| 5,176,090 | 1/1993 | Roberts et al. . | |
| 5,222,444 | 6/1993 | Youell, Jr. et al. | 108/51.3 |
| 5,469,795 | 11/1995 | Moorman | 108/51.3 |
| 5,483,875 | 1/1996 | Turecek et al. | 108/51.3 |
| 5,603,258 | 2/1997 | Besaw . | |
| 5,694,863 | 12/1997 | Chen . | |
| 5,713,289 | 2/1998 | Model . | |
| 5,784,971 | 7/1998 | Chang . | |

FOREIGN PATENT DOCUMENTS

| | | | |
|---|---|---|---|
| 252584 | 6/1964 | Australia | 108/51.3 |

*Primary Examiner*—Jose V. Chen
*Attorney, Agent, or Firm*—Deveau & Marquis

[57] ABSTRACT

The present invention is a force resisting corrugated assembly, and can be constructed into a pallet or dunnage support made from corrugated paperboard that minimizes adverse environmental impact, occupies little space before it is configured, and effectively saves production, storage and transportation costs. The present corrugated paperboard assembly can be shipped and stored as either one or more die-cut and scored corrugated paperboard pieces, thereby eliminating excess volume, with the pieces being readily interconnectable to form a complete pallet or dunnage support assembly. Preferably, the paperboard of the present invention further has a low moisture vapor transmission rate (MVTR), excellent glueability and recyclability. The present invention incorporates a lower and upper frame member foldably constructed from corrugated paperboard blanks. Each frame member has ribs having locking slots. The lower and upper frame members can differ in dimensions, but in a preferred form incorporate nearly identical elements, thus simplifying production of the blanks and the folding steps necessary to form the present corrugated structure. After foldably constructing each frame member, the upper frame member is rotated 90 degrees relative to the lower frame member, and placed upside down over the lower frame member. The ribs of the lower frame member lock into the locking slots of the ribs of the upper frame member, and the ribs of the upper frame member lock into the locking slots of the ribs of the lower frame member.

20 Claims, 13 Drawing Sheets

FORCE RESISTING CORRUGATED ASSEMBLY

BACKGROUND OF THE INVENTION

1. Field of the Invention

The present invention relates generally to a load force resisting corrugated assembly, and specifically to a pallet or dunnage support constructed of corrugated paperboard that minimizes adverse environmental impact, occupies little space before it is configured, and effectively saves production, storage and transportation costs. The present corrugated paperboard assembly can be shipped and stored as either one or more die-cut and scored corrugated paperboard pieces, thereby eliminating excess volume, with the pieces being readily interconnectable to form a complete pallet or dunnage support assembly. In preferred form, two or more of these pieces are nested and glued together to form an assembly. Further, it is preferable that the paperboard of the present invention have a low moisture vapor transmission rate (MVTR), excellent glueability and recyclability.

2. Description of Related Art

Corrugated structures such as containers, boxes and the like are known in the art. Practical corrugated pallets and dunnage supports that work well for their intended purposes, including preferred load bearing strength, recyclability, cost effectiveness and simplicity in construction are not known. Additionally, a corrugated assembly that can serve both as a pallet and dunnage support is not known, although such a construction would be useful. Structural characteristics, including weight bearing and cushioning specifications, useful in the production of a novel corrugated pallet design translate quite naturally into a novel corrugated dunnage support, as both assemblies perform similar functions. In an over simplistic description, the pallet of the present invention can be used as a dunnage support when placed between transported products. The pallet can be stood on edge between the products to provide a cushioned barrier the thickness of the pallet.

Referring specifically to the pallet, it is primarily used as a method of handling materials in large quantities. Pallets typically comprise a flat, elevated surface to support containers or packages a sufficient distance from the floor to permit the forks of a forklift to be inserted under them so that the pallet supporting the load can be moved from place to place. For the purpose of transporting products, using pallets to carry goods provides a simple, economical and efficient method. Goods can be stacked onto pallets that will then be handled by forklifts. In so doing, a lot more goods can be carried in each transporting trip to save human labor and to easily load goods to appropriate places.

Most pallets have been and presently are made of wood. In the past, the majority of pallets were constructed specifically of softwood. Of the available materials prior to a new technology in paperboard construction being developed, softwood provided the best balance of both strength and cost.

However, a number of problems face users of conventional wooden pallets. The cost of making and repairing wooden pallets is rising at a rate that is detracting from the cost effectiveness of palletized shipment. Moreover, empty wooden pallets require substantial space for storage, and it is especially costly to transport empty pallets by rail or truck for reuse.

In an effort to reduce costs, many wood pallet producers have resorted to using lower grades of unseasoned or untreated lumber commonly known as "pallet lumber". Pallet lumber typically has a rough finish and is prone to cracking, warping or the like. Further, such rough finishes present a splinter hazard and are unsuitable for some uses, including food-handling applications. Such low grades of lumber also readily split or break, resulting in pallet failure.

Conventional types of pallets must be returned to the shipper after use so the shipper can reuse them, if possible, or the pallets have to be disposed of in a proper manner. Yet, wood pallets are bulky which makes them inconvenient to store and return to the shipper. Damaged wooden pallets generally can not be taken to a landfill or other waste disposal site. Rather, they must be reduced either by chipping or burning before disposal. Chipping is a significant problem inasmuch as nails and other metal fasteners must be removed from the pallet wood before the chipping operation can be undertaken, adding significant cost to pallet reduction. By the same token, increasingly stringent environmental regulations often preclude the burning of used pallets.

Disposal of the conventional wood and nail pallets is a more serious problem when such pallets are exposed to chemical or biochemical materials that contaminate the pallet, since contaminated parts of the pallet can not be destroyed through incineration. The contaminated parts of the pallets often must be disposed in a hazardous waste landfill, which disposal is also inconvenient and expensive.

As forest resources also have been declining in recent years, pallets constructed of plastic and metal have been developed. While it is true that higher pressure-resistant strength is an advantage of pallets made of plastic and metal, in terms of environmental protection these two other types of pallet material no longer meet the requirements of environmental preservation. Additionally, the heavier pallet materials of plastic and metal pallets do not satisfy economic efficiency when weight is the basis for the calculation of transportation costs. After they are made, the finished products of plastic and metal pallets occupy larger spaces and result in much higher storage and transportation costs than do those made of wood.

Thus, there has been a long felt need for a pallet that is lightweight, inexpensive, strong, and has smooth outward surfaces, which pallet is formed of an alternate material other than wood, plastic or metal.

A demand presently exists for recyclable materials such as corrugated paperboard boxes that may be readily remanufactured into recycled corrugated paperboard. Recyclability provides future cost efficiencies on a large scale. Paperboard is a largely homogenous material (with the exception of minor amounts of adhesive and printing ink, which are acceptable in the recycling process) and may be readily collected at a number of discrete sites (e.g., warehouse, factory, retail store, or the like). In some instances, pallets are used to support a number of corrugated containers (e.g., boxes) which may be attached to the pallet using suitable means (e.g., strapping, shrink-wrap or the like). Thus, it is desirable to provide a pallet that can be recycled in the same material stream as its accompanying corrugated containers.

There have been a variety of attempts over the years to replace wooden pallets with those constructed of paperboard. However, past paperboard pallets were not as sturdy as wooden pallets and none of them received widespread acceptance. In recent years, attempts also have been made to replace the bulky and expensive wooden pallets with corrugated paperboard sheets called slip-sheets. These slip-sheets simply comprise a sheet of corrugated paperboard that is slightly larger than the dimensions of the goods to be stacked thereon. The slip-sheet is neither intended for nor capable of supporting the weight of the stacked goods, and must always be supported on a suitable horizontal surface. By providing an extra marginal edge of corrugated board material, it is possible to grasp and slide the sheets and the goods carried thereon about the floor or onto a specialty designed lift truck.

While slip-sheets have provided cost savings in many industrial situations, they simply are not suitable to fully replace palletized shipments. For example, difficulties have been encountered where heavily loaded slip-sheets are positioned directly adjacent the doorway of a fully loaded boxcar or truck trailer. When so positioned, the lift truck mechanism is unable to grasp a sufficient portion of the slip-sheet to pull it onto the lift truck. A slip-sheet improperly grasped is often ripped. This has necessitated, in many situations, unloading the sheet to move the goods out of the carrier and then restacking the goods on the sheet for transport by a lift truck.

An all-corrugated paperboard pallet is very desirable as it can be recycled along with any corrugated containers carried on the pallet. In warehouses and retail stores (e.g., mall or the like) it is known to provide a separate compactor for compacting and storing corrugated waste. Such waste can then be retrieved and recycled into new corrugated material. In addition to the designs noted above, several attempts have been made by others to produce an all-corrugated paperboard pallet by mimicking the design of a wood pallet, using layers of corrugated paperboard in place of wood boards. Such pallets are heavy and expensive as they attempt to achieve the equivalent strength of a wood pallet, which pallet can comprise several layers of corrugated material (e.g., as many as 16 layers).

Another requirement of a practical pallet design is that the pallet be suitably moisture and water resistant. Water spills, rain and condensation may be present in warehouses, loading docks, trucks, railcars, and the like. In many instances a pallet may be placed in proximity to a location where a risk of flooding may occur leaving the pallet placed in a small amount of standing water. Corrugated paperboard pallets of the prior art are not suitably equipped to sustain such moisture conditions. Moreover, alternative pallet designs of paper core, wood and paper pulp will often disintegrate under such conditions.

A novel corrugated paperboard pallet design is desired that that is capable of overcoming the numerous disadvantages of the conventional pallet, and be made from a converted or remanufactured paper product. In most applications, the corrugated paperboard is a layered structure that is usually die-cut to form corrugated structures. It consists of a fluted corrugated medium sandwiched between sheets of linerboard. The simplest three-ply structure is known as "double face." As recently as 1990, much of the linerboard was made entirely from virgin, long-fibered, softwood, kraft pulp. Today, however, these board grades contain sizeable portions of recycled old corrugated containers (OCC) and many are made from 100% OCC.

Around the country, and even in the rest of the world, landfill space for waste disposal is rapidly reaching capacity. By the year 2000, paper and paperboard products are projected to represent 40.9 percent of the municipal solid waste stream and may climb to nearly 42 percent by 2010. New governmental regulations and the public's increasing concern for the environment have created pressure to remove these materials from the solid waste stream. The most widely utilized method of reducing paper waste is recycling.

OCC has a history of efficient recycling use. Even before the era of government mandates and self-imposed industry goals, almost 50% of OCC was recycled in North America. Today's recovery rate is about 62%. It is expected that a level of 70% will be achieved by the year 2000. Today, most of this recycled material goes directly from retail chain stores and factories to mills based on long-term contracts. The rest comes from municipal curbside collection and wastepaper dealers. Some OCC is used in the production of boxboard, and some is even bleached and used in the production of fine paper, but most OCC is used again to produce corrugating medium and linerboard. "Repulping" refers to any mechanical action that disperses dry or compacted pulp fibers into a water slush, slurry or suspension. The action can be just sufficient to enable the slurry to be pumped, or it can be adequate to totally separate and disperse all the fibers. In a typical recycling process, bales of OCC are fed into a repulper where the material is disintegrated and the gross contaminants are removed. The resulting stock is pumped through pressure screens and cyclonic cleaners to remove oversized materials and foreign matter. Reverse cleaners remove plastics, STYROFOAM® or other lightweight contaminants. The glue, staples, wax, and tapes originally used to assemble the corrugated box must be removed.

Untreated OCC usually creates no problems for recycling. However, paperboard is often treated or coated to enhance its performance and these coatings render the paper unrecyclable. For example, corrugated paperboard is often treated with a curtain coating, wax impregnation, lamination, sizing, or a water-based coating to reduce abrasiveness and to provide for oil and moisture resistance. Moisture vapor transfer rate (MVTR) is a scientific measurement used to describe a product's ability to allow moisture vapor to pass through it, over a specific time period, at a controlled temperature and at a designated atmospheric pressure. While coatings such as wax enhance the moisture resistant properties of the paperboard, the wax coating process is expensive and often renders the paperboard unrecyclable.

In pallet construction, excessive moisture gain can cause a corrugated paperboard pallet to lose its integrity and fail during use, which potentially could lead to heavy economic losses. Traditional solutions generally involve plastic film, either as a laminate with the paperboard or as a bag around the pallet. Both solutions are expensive or incur added labor costs, and greatly reduce or eliminate the recyclability of the pallet. Therefore, there exists a need in the art for coatings that can provide the high moisture resistance needed without compromising the recyclability of the pallet.

The MVTR of a corrugated paperboard pallet is dependent not only upon the coating on the paperboard, but also the method by which that coating is applied. Traditional methods of coating application, such as a rod coater or a blade coater, may result in variations in coating thickness that will cause variations in the MVTR of the coating. The typical solution to this problem has been to merely increase the amount of coating applied to the paperboard. This solution can be expensive and does not result in a consistently coated product both linearly and across the paperboard web.

Referring now to conventional dunnage supports, dunnage support assemblies are frequently employed when transporting industrial articles from one location to another. Known dunnage support assemblies typically comprise a dunnage support member that is secured to a rigid frame. The dunnage support member, itself, is formed of an elastomeric material and has a surface which is adapted to engage and support the dunnage for transportation. The elasticity of the dunnage support member, of course, protects the dunnage from damage that might otherwise result from jarring and vibration of the dunnage during transport.

There have been a number of previously known shipping containers for dunnage, specifically shipping containers for heavy industrial components, such as automotive engines. These previously known shipping containers typically comprise a frame constructed of a rigid material, such as tubular steel. Furthermore, each container is usually designed to transport a number of the industrial components.

Typically, these elastomeric dunnage support members are formed from polyisocyanate that reacts with a resin. The reaction itself is carried out within a mold so that the mold, which conforms in shape to the dunnage support member, forms the part in the desired final shape. Such dunnage support members further can be custom fabricated for the particular dunnage to be transported.

The disposal of previously known dunnage supports after their useful lie, however, presents problems, not unlike the problems associated with damaged wood and plastic pallets. The elastomeric material formed by the reaction of polyisocyanate and resin cannot be recycled and, instead, must be disposed of in a landfill or an equivalent. Such disposal is not only expensive, but also presents potential hazards to the environment.

United States industry has been moving toward the elimination of foam dunnage supports and packaging comprising polystyrene and other foams, principally because of adverse environmental impacts of such type packaging, and accordingly, efforts are directed toward providing a dunnage support that is recyclable. Industries utilizing dunnage supports are varied, and span from the furniture industry to the automobile industry. Any product that is shipped can be protected from scratches, dents and other forms of damage by some sort of dunnage support assembly.

The elastomeric material formed for use as a dunnage support generally is an isomeric material that is spongy. Consequently, once the products are wedged between spaced-apart dunnage support members, the spongy elastomeric material compresses slightly and cushions the dunnage. Another disadvantage of the conventional dunnage support assembly is that the shipping container is often subjected to high impact during transport. This is especially true when train transports the shipping container. In such situations, the spongy dunnage support members have been known to crumble or otherwise abrade during transport. Such abrasion or crumbling of the elastomeric material is unacceptable since it can result in damage to the dunnage.

Thus it can be seen that there is a need for a force resisting corrugated structure that upon construction can be used both as a pallet or a dunnage support, which corrugated structure comprises corrugated board that is capable of minimizing both environmental pollution and transportation expenses, occupying little space before it is configured, and effectively saving production and storage costs. Preferably, the corrugated paperboard pallets and dunnage support assemblies of the present invention have a low moisture vapor transmission rate, excellent glueability and recyclability. It is to the provision of such corrugated structures that the present invention is primarily directed.

SUMMARY OF THE INVENTION

Briefly described, in its preferred form, the present invention forms a force resisting assembly comprising a lower and upper frame member foldably constructed from corrugated paperboard blanks. Each frame member comprises ribs having locking slots. The lower and upper frame members differ in dimensions, but in a preferred form incorporate nearly identical elements, thus simplifying production of the blanks and the folding steps necessary to form the present corrugated structure. After foldably constructing each frame member, the upper frame member is rotated 90 degrees relative to the lower frame member, and placed upside down over the lower frame member. The ribs of the lower frame member lock into the locking slots of the ribs of the upper frame member, and the ribs of the upper frame member lock into the locking slots of the ribs of the lower frame member.

The corrugated paperboard of the present corrugated assembly can comprise numerous embodiments, including a medium between two sheets of linerboard or be multilayered, and incorporate a variety of flute designs. The flute sizes and thickness can be customized to meet specific requirements of strength and flexibility. Preferably, the force resisting corrugated structure assembled into a pallet provides for four-way entry for forklift maneuverability, and may be sent to the end user either in assembled form, or in flat blank form. Formed as a pallet, the present assembly is more aptly termed a load bearing assembly supporting containers and the like above the floor.

The present invention constructed and used as a pallet eliminates numerous disadvantages associated with the use of conventional permanent pallets. The present pallet is comprised of relatively inexpensive materials such as corrugated paperboard, and is secured together by a conventional adhesive such as glue, which does not interfere with the recyclability of the paperboard, so the pallets remain recyclable, disposable in municipal landfills, and inexpensive to manufacture. The corrugated pallet of the present invention is also easy to dispose of in case of contamination due to product spills or damage because all of the materials of construction are biodegradable or can be incinerated without further disassembly. The corrugated pallets are lightweight and have great structural strength. Thus, the corrugated pallets of the instant invention are especially suited for assembly line work for containing or supporting parts which must be supported or stacked in that the worker need not have to handle the weight of a traditional wood and nail pallet. Moreover, the manufacturer does not have the expense of providing lightweight plastic pallets which are usually too costly to use for operations requiring disposal or destruction of the pallet due to contamination.

These advantages of the present corrugated assembly forming a pallet equally apply to the assembly forming a dunnage support. As a dunnage support is placed between two or more surfaces, the present invention resists the forces generated when the surfaces are brought toward one another during settlement or transportation shifting.

Accordingly, it is a principal object of the present invention to provide a disposable and recyclable corrugated paperboard force resisting structure having the lowest possible cost while maximizing its strength and durability.

It is another object of the present invention to provide a disposable pallet or dunnage support assembly capable of manufacture solely from lightweight sheet material such as corrugated paperboard and an adhesive.

It is yet another object of the present invention to provide ribs comprised of corrugated material to support the upper frame member of the pallet high enough above the lower frame member to accommodate the forks of a forklift.

A further object of the present invention is to provide a pallet and dunnage support assembly with ribs being positioned to evenly dissipate the weight of the load or forces imposed.

Another object of the present invention is to construct a pallet and dunnage support assembly that will sustain loads or forces to which it is subjected and not fold or bend sideways in movement or shipment.

Another object of this invention is to provide a paperboard construction having a coating that reduces the MVTR of the paperboard assembly while still allowing the product to be recycled.

These and other objects, features and advantages of the present invention will become more apparent upon reading the following specification in conjunction with the accompanying drawing figures.

DETAILED DESCRIPTION OF PREFERRED EMBODIMENTS

Briefly described, in a preferred form, the present invention provides a force resisting corrugated paperboard assembly that can be used both as a pallet and a dunnage support having high moisture resistance, which assembly is foldably constructed from two flat, die-cut blanks to form, for example, a pallet having a generally flat upper surface for supporting containers or packages a sufficient distance from the floor to permit the forks of a forklift to be inserted under them so that the pallet supporting the load can be moved from place to place. The pallet construction virtually eliminates negative environmental impact and minimizes the shipper's transportation expenses associated with conventional pallet constructions.

The following detailed descriptions of preferred embodiments will mainly refer to a force resisting corrugated assembly formed as a pallet, yet use of the term pallet generally may be interchanged for the terms dunnage support assembly, as the construction of both is similar. When the construction of the pallet diverges from the construction of the dunnage support assembly, special notice will be made in the description.

Figure 1:
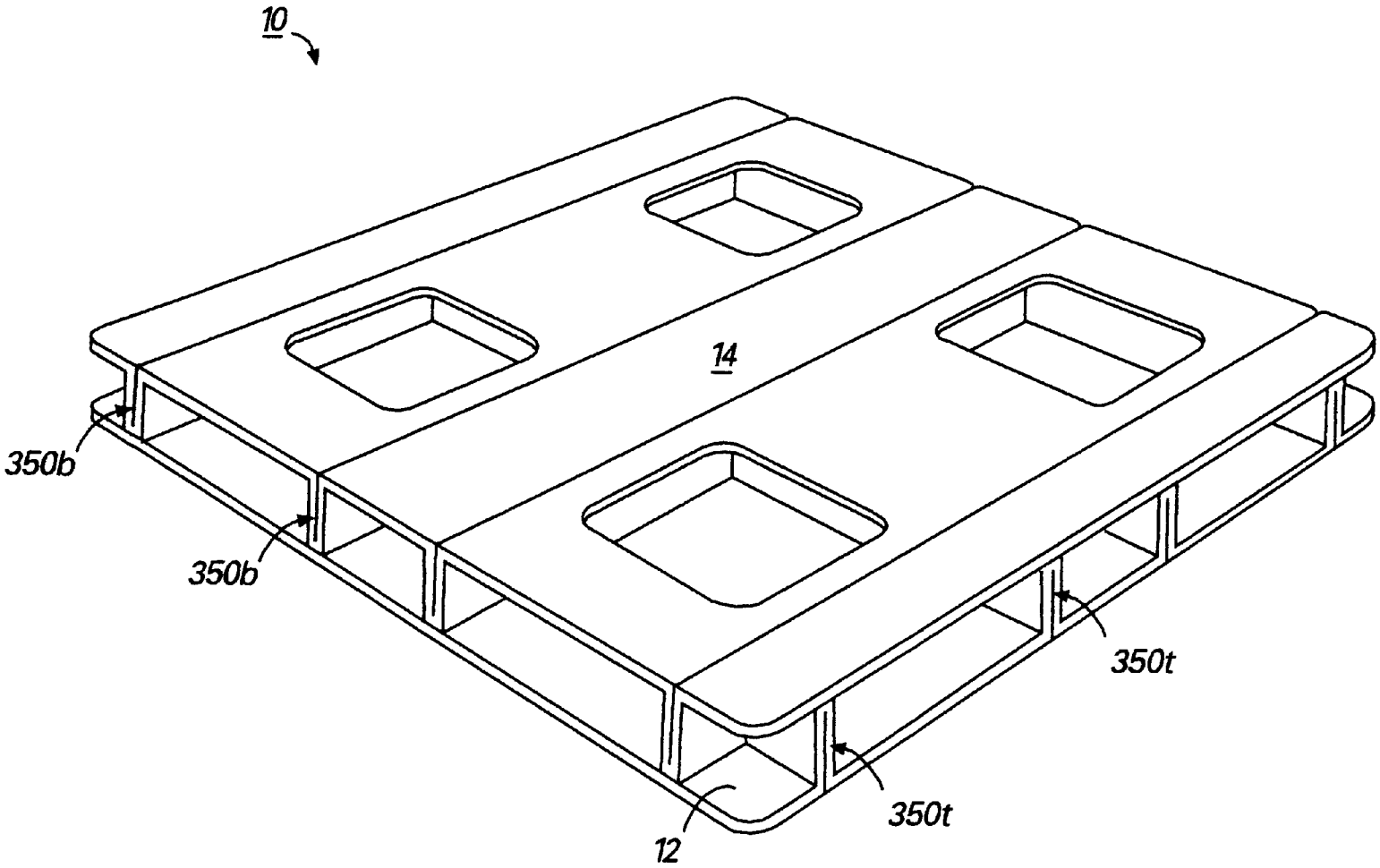
FIG. 1 shows the foldable corrugated paperboard force resisting assembly of the present invention, according to preferred form, in its assembled configuration.

Referring now in detail to the drawing figures, wherein like reference numerals represent like parts throughout the several views, FIG. 1 shows an erected pallet 10 produced by the present invention, which pallet 10 generally comprises a lower frame member 12 and an upper frame member 14, both of which are foldably constructed from blanks.

Figure 2:
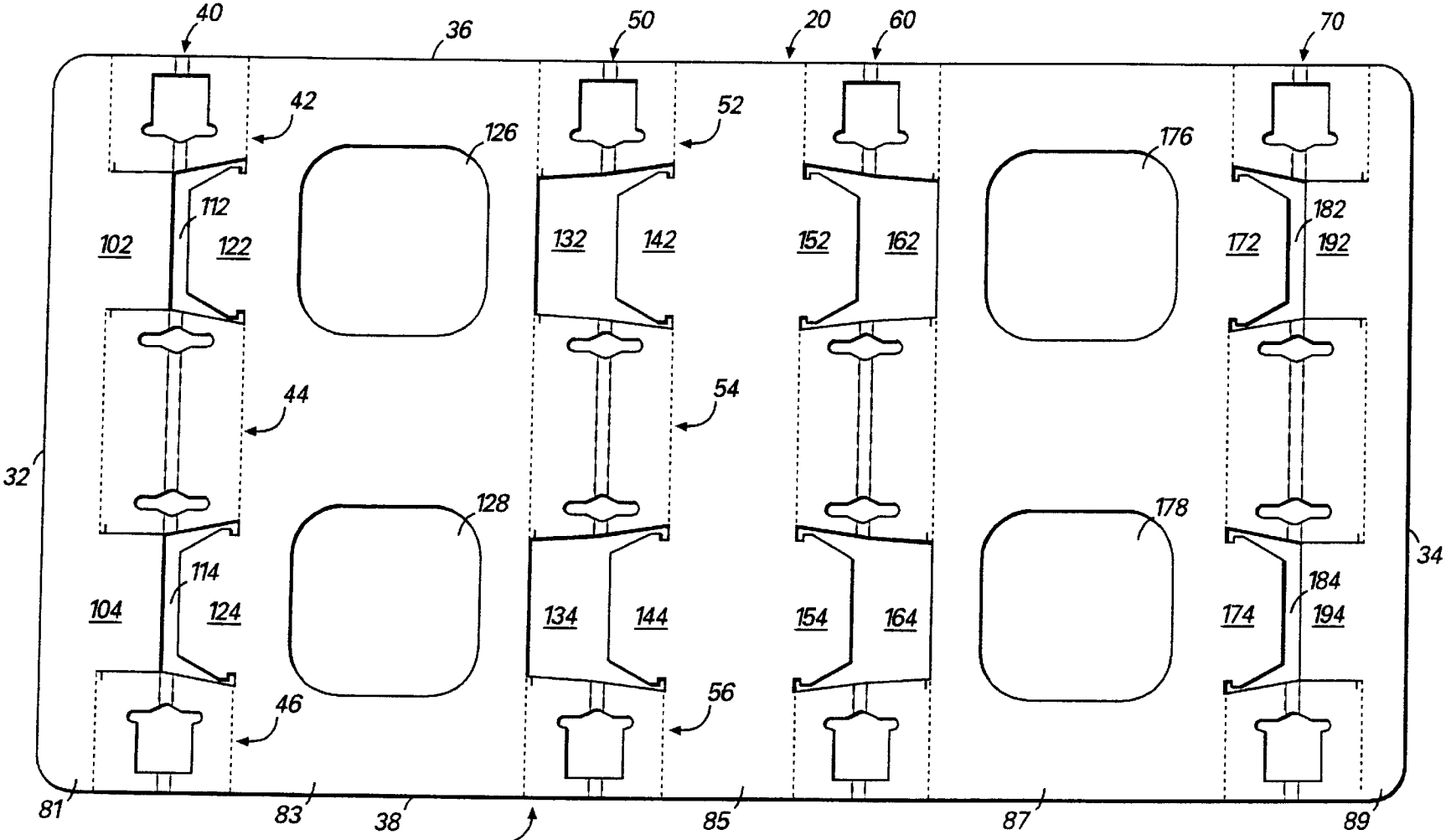
FIG. 2 shows a corrugated paperboard bottom blank according to a preferred form of the present invention.
Figure 3:
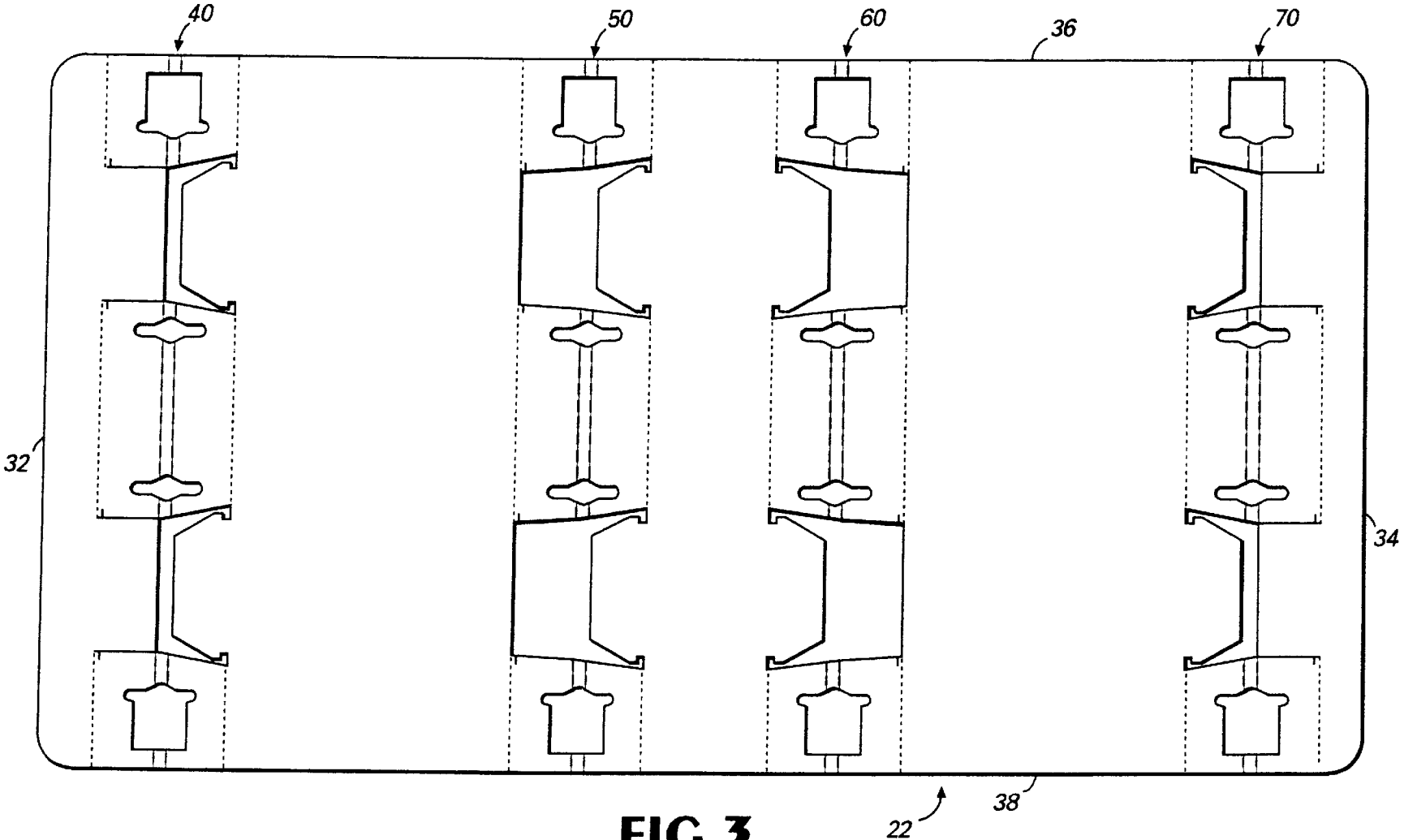
FIG. 3 shows a corrugated paperboard top blank according to a preferred form of the present invention.

The pallet 10 is preferably constructed by folding a bottom blank 20 and a top blank 22, which are respectively shown in a preferred form by FIGS. 2 and 3. The blanks 20, 22 are die-cut and scored, according to known techniques, from flat sheets of corrugated paperboard, which material will be described in greater detail below.

While the present invention preferably comprises two blanks, a single blank folded over itself can comprise the present force resisting assembly 10. Each half of the one blank can incorporate the several elements of the below-described bottom and top blanks 20, 22, and the halves folded one over the other. In another embodiment of the assembly 10, three or more separate blanks can be foldably constructed to form the assembly 10. In this embodiment, two or more blanks can form different pieces of the described bottom and/or top blanks 20, 22.

Preferably, the various elements comprising both the bottom and top blanks 20, 22 are similar in form and function, thus a majority of the description of the composition of the blanks 20, 22 will refer specifically only to the bottom blank 20. Because the elements of both blanks 20, 22 are similar, one reference number will be used to illustrate an element similar to both the bottom and top blanks 20, 22. When clarity is required between a similar element of both blanks 20, 22, for example, when describing the foldable construction of the present invention 10, such differentiation between two elements will include the use of the letters "b" and "t" next to a reference number, thus referring to a bottom blank element or a top blank element. It will be understood upon reference to the description and the drawing figures that similar elements comprising both bottom and top blanks 20, 22 are designed in similar ways.

For clarity, the detailed description of pallet 10 is broken into two subsections: The Assembly Blanks and The Assembly Construction.

The Assembly Blanks

The bottom blank 20 preferably is comprised from corrugated paperboard. As used herein, "paperboard" refers to a web of cellulosic fibers in sheet form. The term paperboard includes paper and paperboard of different thicknesses. The preferred paperboard is virgin kraft paperboard of a weight known as linerboard. It has more strength than recycled board because its fibers are generally tougher and the board has fewer impurities. As is well known in the art, a chemical cooking process using sodium hydroxide and sodium sulfide produces kraft paperboard, and there are many different types of kraft paperboard manufactured with various additives and treatments for various applications. The pallet may also make use of reprocessed paperboard, that is, not virgin kraft paperboard.

A surface treatment may be employed as part of the conversion process to alter the surface characteristics of the paperboard being used. Typical surface treatment processes include altering the wettabillty of a substrate, improving the bondability of an applied material or the elimination of an accumulated static charge. Surface treatment technologies can play a key role in the preparation of surfaces of paperboard for subsequent processing steps. In the preparation of the pallet paperboard of the present invention, the paperboard may be fed through flame treating means where the surfaces to be coated are flamed by one or more gas burners to burn off loose fibers and debris, and reduce the water content of the paper. The flame treatment of the present invention has several benefits. Most importantly, it provides a better paper surface by burning off loose fibers and other surface matter that would interfere with a continuous coating of, for example, a moisture barrier. The loose fibers, if not removed by the flame treatment, would cause disturbances in the coating, and provide a conduit for moisture to pass through the coating and into the board. This process, commonly referred to as wicking, attracts moisture along the loose fiber, through the coating, and into the paperboard. Not only does this cause a weakening of the paperboard, but also renders the paperboard product less effective as a moisture barrier.

Furthermore, by preventing moisture from wicking through the coating of corrugated paperboard, and by preventing moisture from penetrating the coating under severe humidity or water soaking conditions, the flame treatment is very significant with respect to the ultimate strength of the corrugated pallet in wet conditions.

Advantages of flame treatment over other surface treatments include freedom from ozone, pinholing, and unwanted treatment of the back of the board. Furthermore, the heat generated by the corona may dry out the fibers more than desired, causing them to expand.

From the pre-heater, the paperboard may be fed through a series of rollers to a coating means. There are four main kinds of modern coating processes: blade coating, air knife coating, roll coating, and rod coating. Blade coating and air knife coating can be done in line or off the paperboard machine. Rod coating usually is done "off" the paperboard machine and can either be a complete coating or a first coat followed by an "off-machine" coating by the blade or air knife process. While all four coating methods may be used, it has surprisingly been found that air knife coating results in the most consistent coating.

In an air knife coating process, the coating mixture is applied by a metal roller and distributed by a thin, flat jet of air from a slot in a metal blade extending across the machine. In contrast, in blade coating the mixture is applied to the surface by rollers to give a thin, level coating. Excess coating is removed by a thin flexible metal blade as it smoothes the surface.

The preferable coating composition used on the paperboard of the present pallet is a water-dispersible polymer suspension, preferably comprising 20%–40% solids. The preferred coating composition is an aqueous dispersion of a polyester resin; preferably, polyethylene, polyethylene terephthalate (PET), or polypropylene.

A further preferred water-dispersible polymer is a water-soluble or water-dispersible polyester resin as described in U.S. Pat. No. 4,977,191 to Salsman, incorporated herein by reference. More specifically, U.S. Pat. No. 4,977,191 describes a water-soluble or waterdispersible polyester resin, comprising a reaction product of 20–50% by weight of waste terephthalate polymer, 10–40% by weight of at least one glycol and 5–25% by weight of at least one oxyalkylated polyol.

A further preferred water-dispersible polymer is a sulfonated water-soluble or water dispersible polyester resin composition as described in U.S. Pat. No. 5,281,630 to Salsman, incorporated herein by reference. Specifically, U.S. Pat. No. 5,281,630 describes an aqueous suspension of a sulfonated water-soluble or water dispersible polyester resin comprising a reaction product of 20–50% by weight terephathlate polymer, 10–40% by weight at least one glycol and 5–25% by weight of at least one oxyalkylated polyol to produce a prepolymer resin having hydroxyalkyl functionality, wherein the prepolymer resin is further reacted with about 0.10 mole to about 0.50 mole of an alpha, beta-ethylenically unsaturated dicarboxylic acid per 100 g of prepolymer resin and a thus produced resin, terminated by a residue of an alpha, beta-ethylenically unsaturated dicarboxyclic acid, is reacted with about 0.5 mole to about 1.5 mole of a sulfite per mole of alpha, beta-ethylenically unsaturated dicarboxylic acid residue to produce a sulfonated-terminated resin.

Yet another water-dispersible polymer is the coating described in U.S. Pat. No. 5,726,277 to Salsman, incorporated herein by reference. Specifically, U.S. Pat. No. 5,726,277 describes a coating composition comprising a reaction product of at least 50% by weight of a waste terephthalate polymer and a mixture of glycols including an oxyalkylated polyol in the presence of a glycolysis catalyst wherein the reaction product is further reacted with a difunctional, organic acid and wherein the weight ratio of acid to glycols is in the range of 6:1 to 1:2.

While the above examples are provided as the preferred water-dispersible polymer coating compositions, other water-dispersible polymers are suitable for use on the present pallet. By way of example only, and not meant to be limiting, further suitable waterdispersible compositions are described in U.S. Pat. No. 4,104,222 to Date et al., incorporated herein by reference. U.S. Pat. No. 4,104,222 describes a dispersion of a linear polyester resin obtained by mixing a linear polyester resin with a higher alcohol/ethylene oxide addition type surface-active agent, melting the mixture and dispersing the resulting melt by pouring it into an aqueous solution of an alkali under stirring. Specifically, this dispersion is obtained by mixing a linear polyester resin with a surface-active agent of the higher alcohol/ethylene oxide addition type, melting the mixture, and dispersing the resulting melt by pouring it into an aqueous solution of an alkanolamine under stirring at a temperature of 70°–95° C., said alkanolamine being selected from the group consisting of monoethanolamine, diethanolamine, triethanolarnine, monomethylethanolamine, monoethylethanolarnine, diethylethanolamine, propanolarnine, butanolamine, pentanolamine, N-phenylethanolamine, and an alkylolamine of glycerine, said alkanolarnine being present in the aqueous solution in an amount of 0.2 to 5 weight percent, said surface-active agent of the higher alcohol/ethylene oxide addition type being an ethylene oxide addition product of a higher alcohol having an alkyl group of at least 8 carbon atoms, an alkyl-substituted phenol or a sorbitan monoacylate and wherein said surface-active agent has an HLB value of at least 12.

Likewise, by way of example, U.S. Pat. No. 4,528,321 to Allen discloses a dispersion in a water immiscible liquid of water soluble or water swellable polymer particles and which has been made by reverse phase polymerisation in the water immiscible liquid and which includes a non-ionic compound selected from C4–12 alkylene glycol monoethers, their C1–4 alkanoates, C6–12 polyalkylene glycol monoethers and their C1–4 alkanoates.

Those in the art will understand that the various coatings will have varying heat tolerances and tensile strengths. It is within the skill in the art to select the appropriate coating for a given application without undue experimentation.

In the finished, coated product, adherence of the coating to the paperboard is such that they are essentially inseparable, that is, peeling is practically impossible. The fibers of the paperboard will separate before the coating will peel from the paperboard.

The preferable paper coating method and apparatus used to coat the present pallet blanks is described in U.S. patent application Ser. No. 09/195,172 entitled "paper Coating Method and Apparatus", incorporated herein by reference.

Alternatively, the pallet can be constructed from a composite laminate material fabricated by passing a web of paperboard or kraft paper and a web of plastic film such as a bioriented polyester through the nip of a pair of nip rolls, extruding a molten plastic impregnating and bonding agent between the paper and plastic film webs, such that part of the molten plastic agent impregnates partially into and becomes part of the paper web and a portion of the plastic agent extends outwardly of the paper web surface and forms a new solidified surface on which the plastic film is supported and to which the plastic film is firmly bonded.

The bottom blank 20 of FIG. 2 preferably comprises a bottom panel 30 and bottom foldable column panels 40, 50, 60, 70. Upon foldable construction, the bottom panel 30 of blank 20 remains generally parallel to and in proximity to the floor surface, while the foldable column panels 40, 50, 60, 70 rise to form vertical ribs generally perpendicular to the floor surface. When the bottom blank 20 is foldably assembled, it forms the lower frame member 12 of the pallet 10. The bottom blank 20 is generally rectangular in shape, and is bounded by first and second ends 32, 34, and first and second sides 36, 38.

It should be noted that in the following description, references to lengths, widths and thickness might vary in orientation between the several elements of the pallet 10. For example, the bottom blank 20 is shown and described as having a length equal to the length of sides 36, 38, a width equal to the length of ends 32, 34, and a thickness equal to the thickness of the blank comprising bottom blank 20. Yet, when describing various elements of bottom blank 20, some elements may be described as having a length running parallel to, for example, ends 32, 34 (instead of sides 36, 38), and a width running parallel to sides 36, 38 (instead of ends 32, 24). Additionally, at times, the thickness of an element may relate to a measure in the direction of length or width of blank 20, and not thickness in the sense of the thickness of blank 20.

First, second, third and fourth bottom foldable column panels 40, 50, 60, 70 of the bottom blank 20 are shown each comprising three separate column panel sections. For example, first bottom foldable column panel 40 comprises column panel sections 42, 44, 46.

The bottom panel 30 of the bottom blank 20 has a top face and a bottom face, and, as illustrated in FIG. 2, comprises edge panels 81, 89, jack panels 83, 87, and middle panel 85. Upon manipulation into the assembly 10 of the present invention, the top face of the bottom panel 30 faces upward, inside the assembled invention, and the bottom face lies atop the ground or other surface upon which the assembly rests. FIG. 2 illustrates an unassembled or unfolded bottom blank 20, and therefore depicts the foldable column panels 40, 50, 60 70 and the elements of the bottom panel 30 in the same plane. Edge panel 81 comprises edge flaps 102, 104 and extends from left to right from first end 32 to first column panel sections 42, 44, 46 and the edge flaps 102, 104.

Jack panel 83 comprises two jack flaps 122, 124 and has cut therethrough two jack passages 126, 128 for the use of a floor jack to lift the constructed pallet 10. Jack panel 83 extends between column panel sections 42, 44, 46 and jack flaps 122, 124, and second column panel 50. Cutouts 112, 114 lie between edge flaps 102, 104 and jack flaps 122, 124, respectively.

Middle panel 85 comprises four generally identical flaps, middle flaps 142, 144, 152, 154. Middle panel 85 extends between second and third column panels 50, 60 and the edges of flaps 142, 144 to the edges of flaps 152, 154. Between jack panel 83 and middle flaps 142, 144 lie cutouts 132, 134, respectively.

Jack panel 87 comprises two jack flaps 172, 174 and has cut therethrough two jack passages 176, 178. Jack panel 87 extends between third column panel 60 and fourth column panel 70 and the edges of jack flaps 172, 174. Between middle flaps 152, 154 and jack panel 87 lie cutouts 162, 164, respectively.

Edge panel 89 extends from both fourth bottom column panel 70 and the edges of edge flaps 192, 194 to end 34. Between jack flaps 172, 174 and edge flaps 192, 194 lies cutouts 182, 184, respectively.

Neither the pallet nor the dunnage assembly of the present invention need comprise jack panels 83, 87 with jack passages, as jack panels 83, 87 may be integral throughout without any apertures for inserting a jack. Further, as described under THE ASSEMBLY CONSTRUCTION, the number of flaps associated with each panel can vary. At a minimum, adjacent panels need only comprises a single flap, extending from either panel, so the column panel can lock into an upwardly extending rib. For example, as shown in FIG. 2, adjacent panels 81, 83 have between them both four flaps 102, 104, 122, 124 extending from edge panel 81 and jack panel 83, respectively. Adjacent panels 83, 85 have between them both two flaps 142, 144 extending from middle panel 85. Yet in an alternative embodiment, only a single flap extending from either panel 81, 83 and extending from either panel 83, 85 is needed to lock the column panels 40, 50, respectively, into ribs. As will be described, the at least one flap between adjacent panels will comprise a flap lock assembly.

Bottom and top blanks 20, 22 preferably are symmetrical about both a vertical and horizontal line of bisection. Similar elements of the bottom blank 20 on either side of each line of bisection are generally identical mirror images of one another. Further, first and second column panels 40, 50 are generally identical. Therefore, for purposes of brevity, only edge panel 81, first column panel 40, jack panel 83 and middle panel 85 will be described below in detail. It will be understood that columns 50, 60, 70, jack panel 87 and edge panel 89 are of similar construction to those described.

Figure 4:
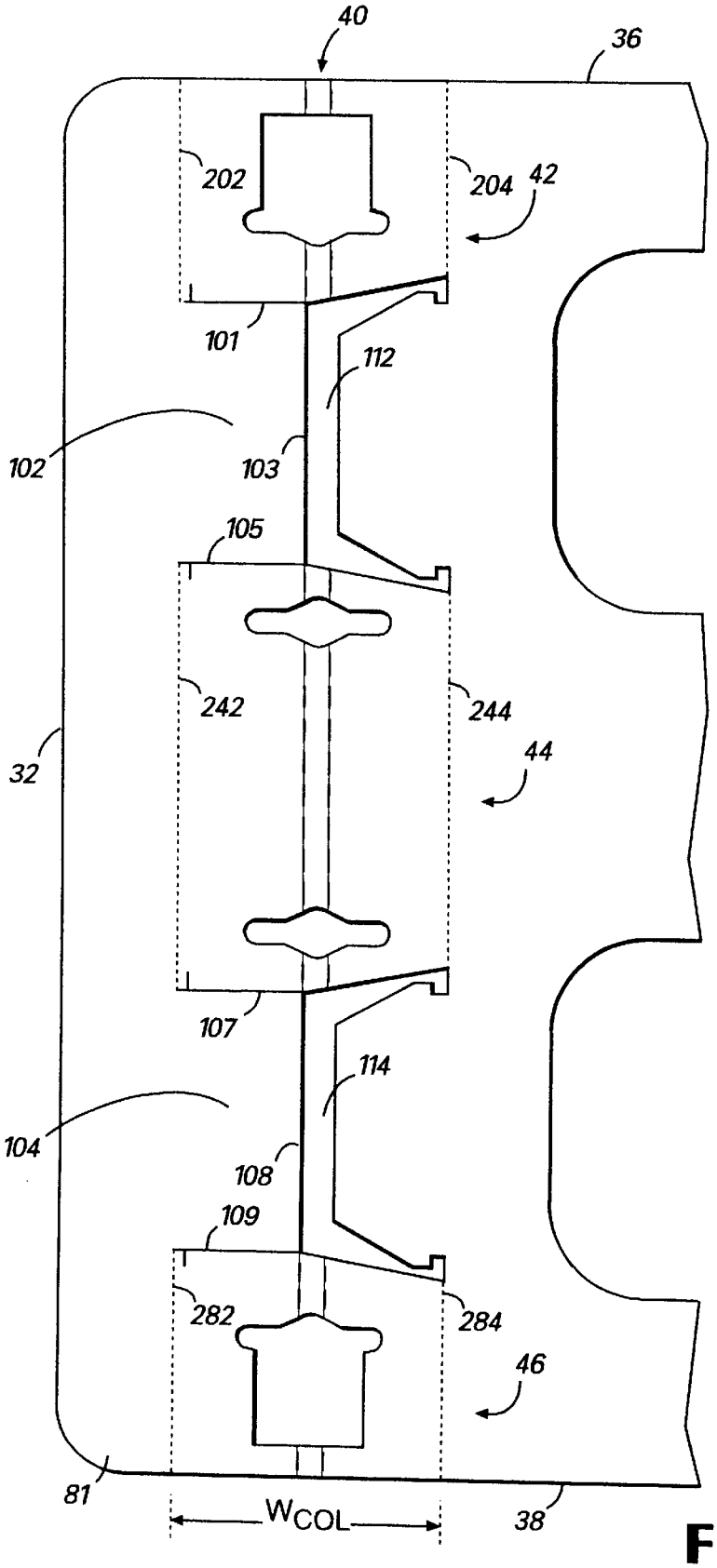
FIG. 4 illustrates a preferred edge panel and bottom foldable column panel of the blank of FIG. 2.

As shown in FIG. 4, edge panel 81 has two edge flaps 102, 104 extending between column panel sections 42, 44 and 46. Edge flap 102 is defined by edge end 103 and side slits 101, 105 cut into bottom blank 20. Edge flap 104 is defined by edge end 108 and side slits 107, 109. The end of edge panel 81 distal end 32 of bottom blank 20 further comprises score lines 202, 242, 282. Side slits 101, 105, 107, 109 and score lines 202, 242, 282 differentiate edge panel 81 from first column panel 40. Score lines 202, 242, 282 preferably lie in a straight line perpendicular to the first and second sides 36, 38 of bottom blank 20. In an alternative embodiment of edge panel 81, edge panel 81 does not incorporate edge flaps 102, 104, wherein cutouts 112, 114 extend into edge panel 81 to a straight line comprising an extension of score lines 202, 242, 282.

Figure 5:
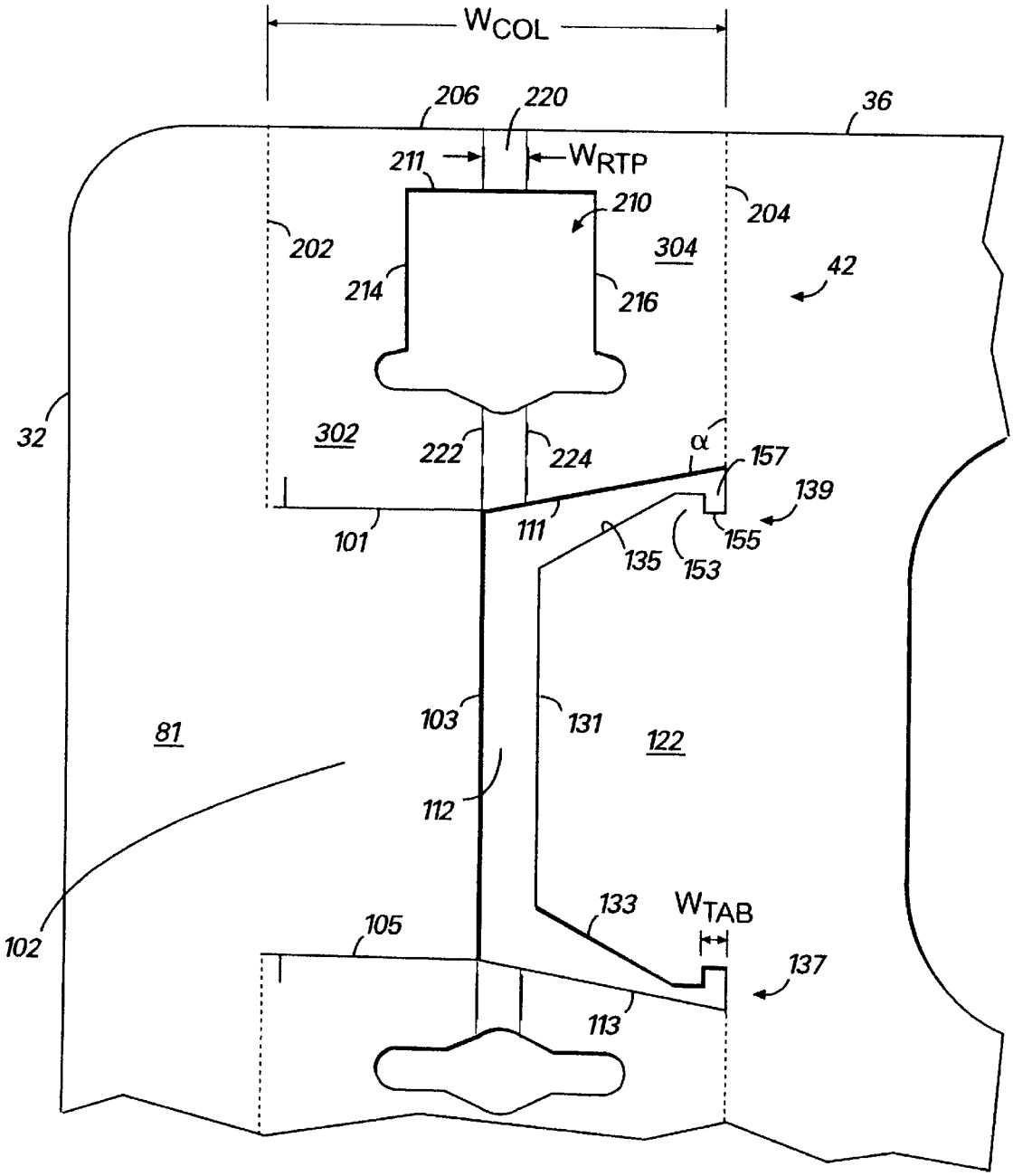
FIG. 5 illustrates a preferred side column panel section of the foldable column panel of FIG. 4.

First column panel 40 comprises column panel sections 42, 44, 46. Foldable column panel 40 has a width $W_{COL}$ illustrated as the width between score lines 202, 204 of column panel section 42 and, therefore, each panel section 42, 44, 46 has a width equal to $W_{COL}$. As shown in FIG. 5, column panel section 42 is that portion of first column panel 40 enclosed by side portion 206 of side 36, score lines 202, 204, slit 101 and sidecut 111 of cutout 112. Preferably, score lines 202, 204 are parallel, and score line 202 and slit 101 are substantially perpendicular to each other, while the angle a between score line 204 and sidecut 111 is greater than 90 degrees, which angle α provides for a locking relationship of jack flap 122 over edge flap 102 upon assembly of the pallet 10.

As pointed out previously, embodiments of the assembly 10 may comprise only a single flap between adjacent panels, wherein the at least single flap will comprise flap lock assemblies, which flap lock assemblies 137, 139 are described below and shown incorporated in jack flap 122. Thus, referring to FIG. 5, if edge panel 81 had the only flap between the adjacent panels 81, 83, which flap extended from edge panel 81 at the location of edge flap 102, the flap would appear in large part like jack flap 122 having locking assemblies 137, 139. Further, in this embodiment, score line 204 and sidecut 111 are substantially perpendicular to each other, while the angle α shown between score line 204 and sidecut 111 in FIG. 5 would exist between score line 202 and slit 101, which angle a between score line 202 and slit 101 would also provide for a locking relationship of the flap extending from the edge panel over jack panel 83, as jack flap 122 would not exist.

Generally centered within column panel section 42 is lock aperture 210. Lock aperture 210 preferably incorporates a locking slot 212 located on the side of lock aperture 210 opposite side 211 proximal to side portion 206. Locking slot 212 extends a length beyond the length of lock aperture 210. Column panel section 42 further includes column top panel 220 having a width $W_{RTP}$ between score lines 222, 224, spanning the length of the width of panel section 42, yet interrupted through lock aperture 210. Column top panel 220 further preferably divides panel section 42 into column side panels 302, 304 adjacent column top panel 220.

Figure 9:
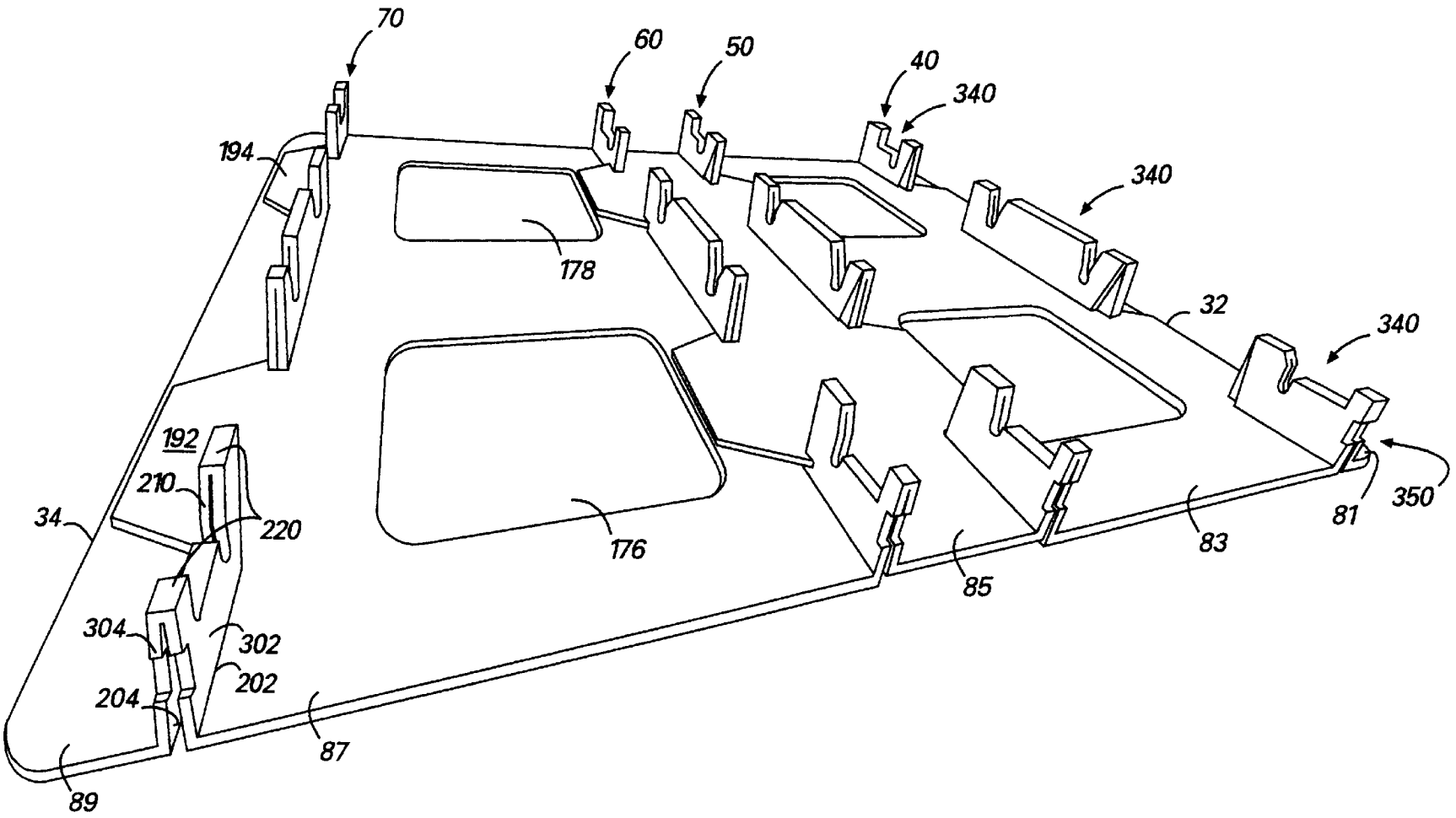
FIG. 9 is a perspective view of the lower frame member of the present invention, in an assembled configuration.

Upon manipulation of column panel section 42 via folding, score lines 202, 204 are drawn together, thus raising rib top panel 220 upward from the flat plane of bottom panel 30, as illustrated in FIG. 9, while score lines 222, 224 break and fold approximately 90 degrees. (FIG. 9 illustrates column panel section 72 of forth column panel 70, which section 72 is identical to column panel section 42.) The column side panels 302, 304 rise between score lines 202, 204 and rib top panel 220. In this configuration, column side panels 302, 304 form rib sides 302, 304. Rib sides 302, 304 have side edges. Lock aperture 210 provides a generally flat notch having a bottom ledge in the middle of rib top panel 220 comprising the adjacent side edges 214, 216 of the lock aperture 210 brought together during folding. Locking slot 212 dips below the bottom ledge of the notch because locking slot 212 extends a length beyond the length of lock aperture 210 defined between the side edges 214, 216 of the lock aperture 210.

Figure 6:
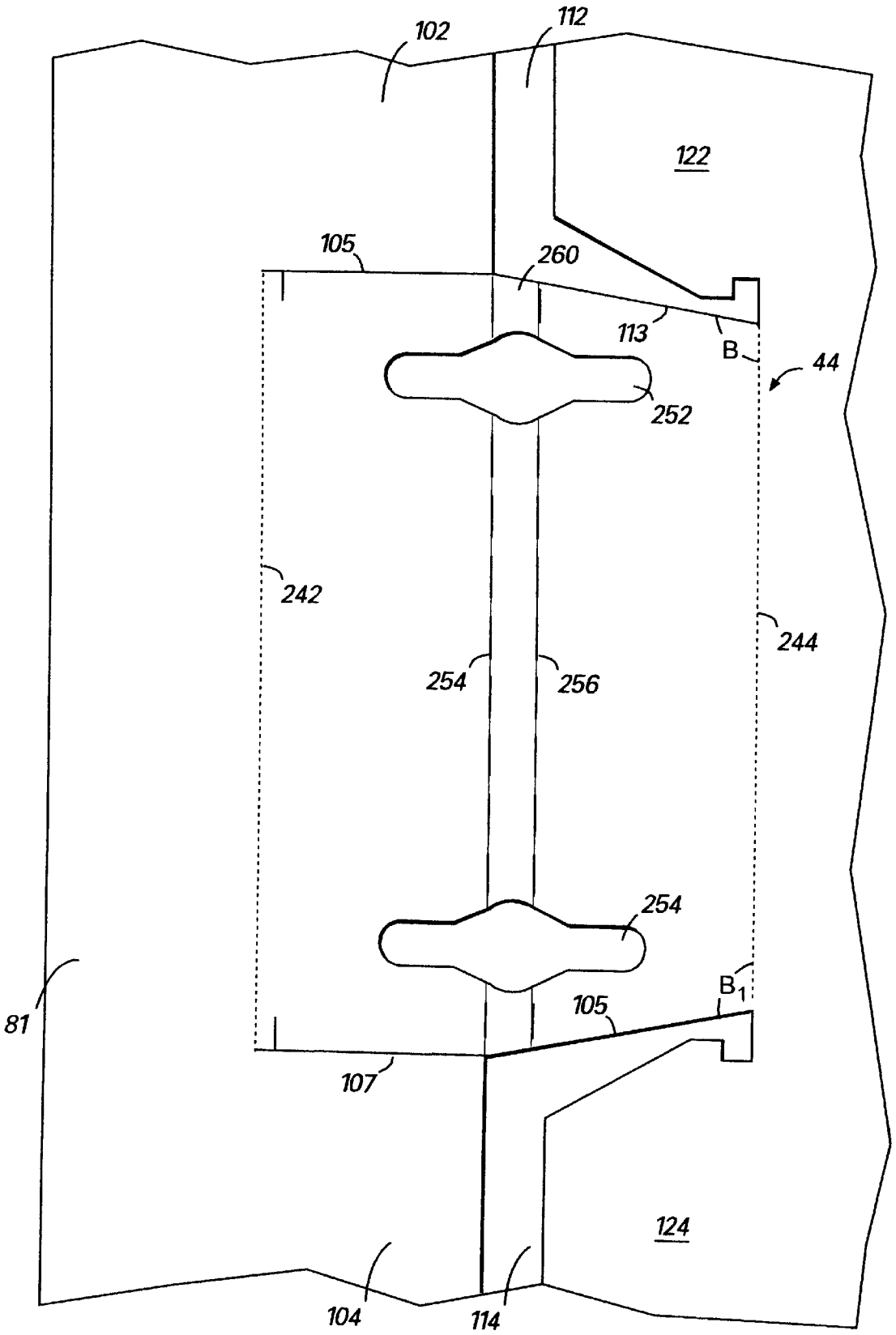
FIG. 6 illustrates a preferred middle column panel section of the foldable column panel of FIG. 4.

As shown in FIG. 6, column panel section 44 is that portion of first column panel 40 enclosed by slit 105, sidecut 113 of cutout 112, score lines 242, 244, slit 107 and sidecut 115 of cutout 114. Preferably, score lines 242, 244 are parallel and side slits 105, 107 are substantially perpendicular to score line 242, while angles β between score line 244 and knifecuts 113, 115 are greater than 90 degrees, again which provides for a locking relationship ofjack flaps 122, 142 over edge flaps 102, 104, respectfully, upon assembly of the pallet 10.

Generally centered along both a first and third line of intersection running perpendicular to score lines 242, 244, while lines separate the length of score lines 242, 244 into four equal segments (the second line of intersection cutting score lines 242, 244 in half) within column panel section 44 are two locking slots 252, 254, both generally identical to locking slot 212 of lock aperture 210. Column panel section 44 further includes column top panel 260 between score lines 254, 256, spanning the length of panel section 44, yet interrupted through locking slots 252, 254.

Upon manipulation of column panel section 44 through folding, score lines 242, 244 are brought together, raising column top panel 260 upward from the flat plane of bottom panel 30. Locking slots 252, 254 provide vertical slots cut within rib top panel 260. The orientation of locking slots 252, 254 and column top panel 260 of column panel section 44 preferably align with the locking slot 212 and column top panel 220 of column panel section 42 so that rib top panels 220, 260 and locking slots 212, 252, 254 present continuity of the structure upon folding.

Figure 10:
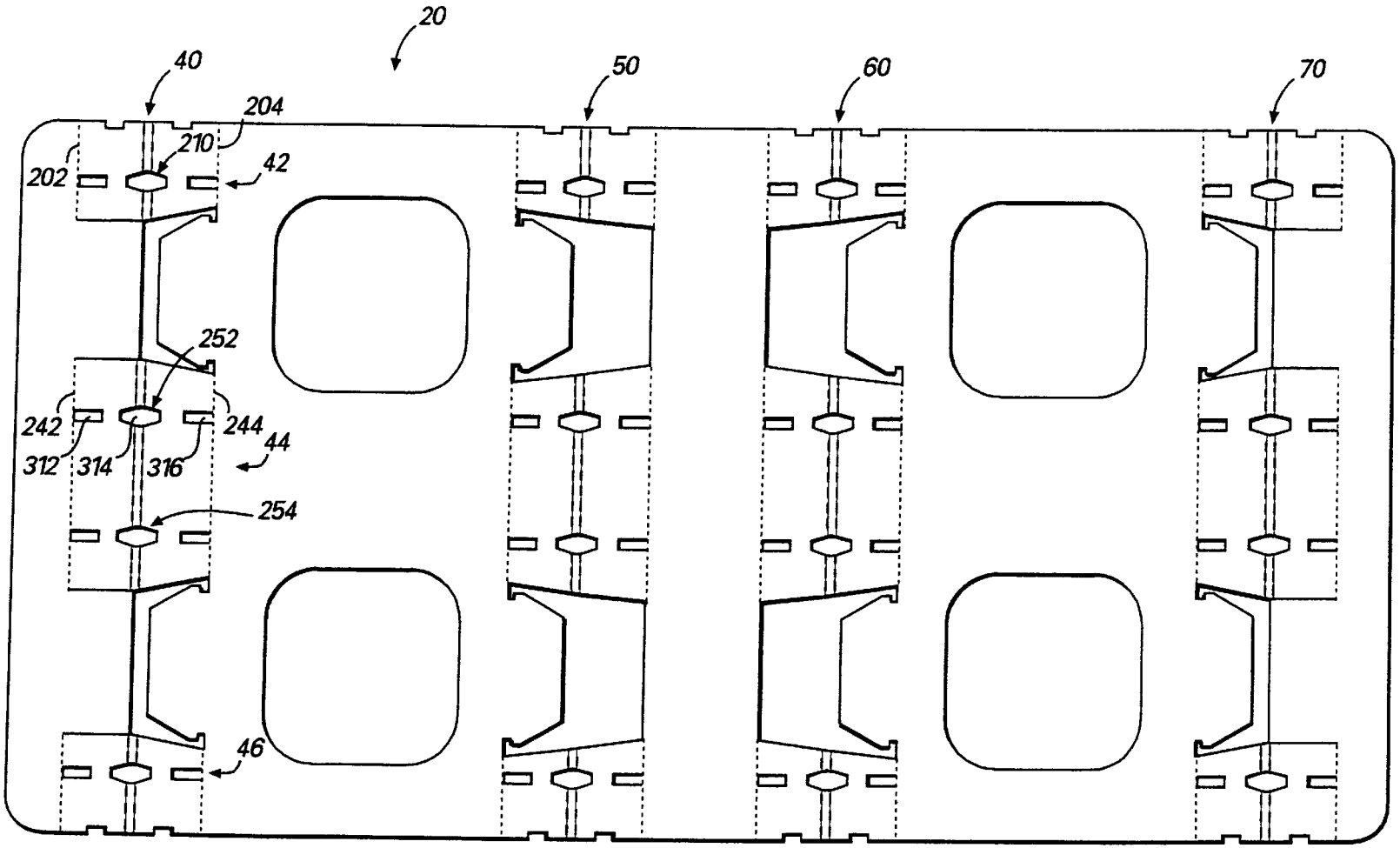
FIG. 10 shows a corrugated paperboard bottom blank according to another preferred form of the present invention.

In an alternative embodiment of column panel sections 42, 44 illustrated in FIG. 10, lock locking slot 252, as shown in FIGS. 5 and 6 is replaced by three locking slot portions 312, 314, 316. The lock aperture 210 of column panel section 42 beyond that of locking slot 212 is removed from the embodiment of panel section 42 shown in FIG. 10. Locking slot portions 312, 314, 316 would form a solid aperture similar to locking slot 252, if locking slot portions 312, 316, 316 were connected to form a single aperture. Locking slot portion 314 is wider than the width of locking slot portions 312, 316. Further, locking slot portions 312, 316 of column panel section 44 extend a length to contact score lines 242, 244, respectively.

Figure 7:
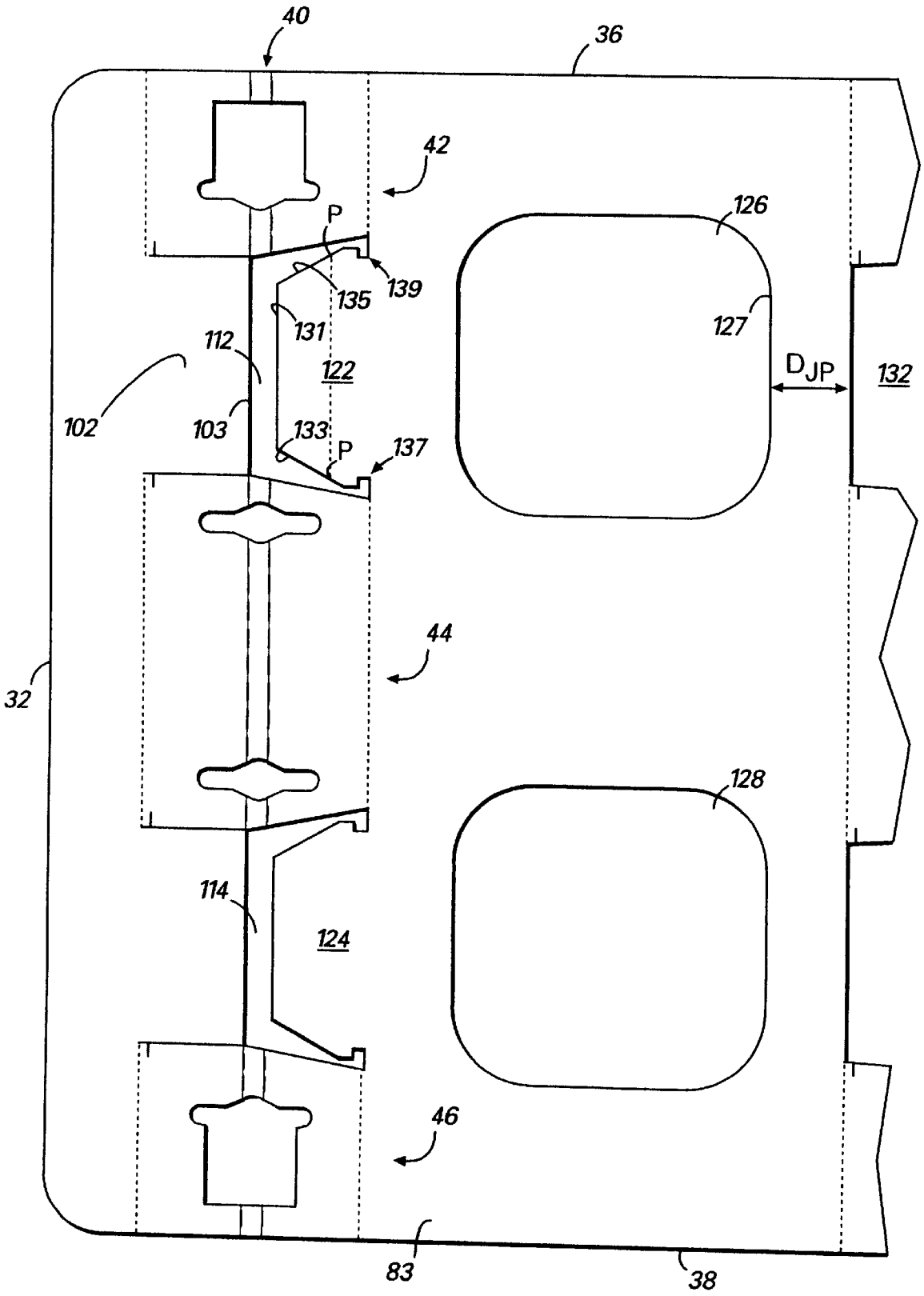
FIG. 7 illustrates a preferred jack panel of the blank of FIG. 2.

FIG. 7 illustrates jack panel 83 having jack flaps 122, 124 and jack passages 126, 128. Jack flap 122 preferably comprises head edge 131, angled side edges 133, 135 and jack flap lock assemblies 137, 139. Preferably, head edge 131 is shorter than edge end 103 of edge flap 102. Side edges 133, 135 flare away from edge head 131, forming obtuse angle therebetween. Preferably side edges 133, 135 extends past a point p, at which point the line pp between point p on side edge 133 and point p on side edge 135 equals the length of edge end 103 of edge flap 102.

At the base of jack flap 122 are flap lock assemblies 137, 139, which cutouts forming .=flap lock assemblies 137, 139 are incorporated in cutout 112. As shown in FIG. 5, assembly 139 preferably includes lock tab 153 below which is notch 157 having a width of $W_{TAB}$ that is approximately equal to two times the thickness of bottom panel 30. The distance between notch side 155 of notch 157 and first side 36 is shown as $L_{111}$. The distance between side slit 101 of edge flap 102 and side 36 is shown $L_{101}$. When column panel section 42 is folded into a rib portion 340, as further described under THE ASSEMBLY CONSTRUCTION, the then upwardly extending column side panel 302 of rib portion 340 in proximity to slit 101 should fit smoothly into notch 157. It should be noted that preferably only the column side panel (panel 302 as shown in FIG. 5) that is not the column side panel that incorporates angle α (panel 304), will be engaged in notch 157. Notch 157 incorporates angled sidecut 111 making it difficult for lock tab 153 to contain column side panel 304 within notch 157. Preferably, the distance $L_{111}$ should approximately equal the distance $L_{101}$. In embodiments incorporating ever shorter distances $L_{111}$ as compared to $L_{101}$, the edge of rib portion 340 in proximity to slit 101 will crumple against notch side 155, and will not rest smoothly within notch 157. Alternatively, in embodiments of ever increasing distances $L_{111}$ as compared to $L_{101}$, lock tab 153 may not releasably catch the edge of rib portion 340 in proximity to slit 101 at all.

Figure 8:
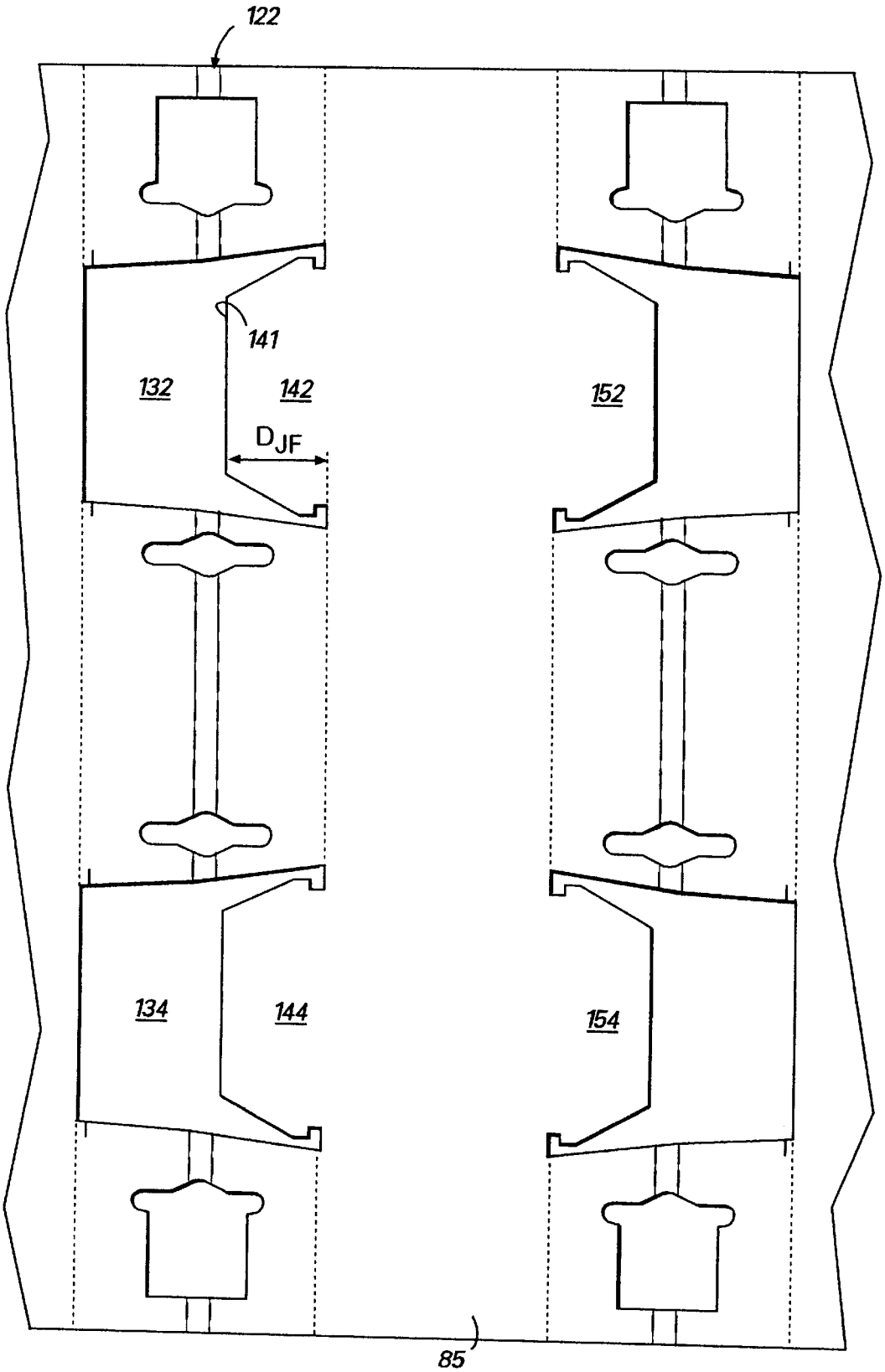
FIG. 8 illustrates a preferred middle panel of the blank of FIG. 2.

Middle panel 85 shown in FIG. 8 comprises four middle flaps 142, 144, 152, 154. Each middle flap is generally identical to jack flap 122 described in detail above. Middle flaps 142, 144, 152, 154 serve the same locking purpose and function as does jack flap 122, although middle flap 142 does not slide over an edge flap as does jack flap 122, but slides over a portion of jack panel 83. Illustrated in FIG. 8, cutout 132 is larger than cutout 112 by the approximate area of edge flap 102. When second column panel 50 is similarly folded as column panel 40 to produce a heightened rib, middle flap 142 is extended up and over jack panel 83 wherein head edge 141 of middle flap 142 moves toward and rests in proximity to an edge 127 ofjack opening 126, shown in FIG. 7. Preferably head edge 141 is adjacent edge 127 because the distance between cutout 132 and end 127 designated as $D_{JP}$ (FIG. 7) is approximately equal to the length of middle flap 142 designated as $D_{JP}$.

Thus described, bottom blank 20 comprises a plurality of generally identical foldable column panel sections, flaps and cutout portions.

Top blank 22 as shown in FIG. 3 comprises nearly an identical layout as bottom blank 20, although top blank 22 does not have jack passages as does the preferred bottom blank 20. The bottom panel 30 of the top blank 22 has a top face and a bottom face. Upon manipulation into the assembly 10 of the present invention, the top face of the bottom panel 30 faces upward, outside the assembled invention, and the bottom face faces downward, inside the assembled invention. This reference to the top and bottom face of the bottom panel 30 of the top blank 22 is opposite the orientation of the top and bottom face of the bottom panel 30 of the bottom blank 20 because, upon construction of the assembly 10, the top blank 22 is turned upside over the bottom blank 20.

Figure 11:
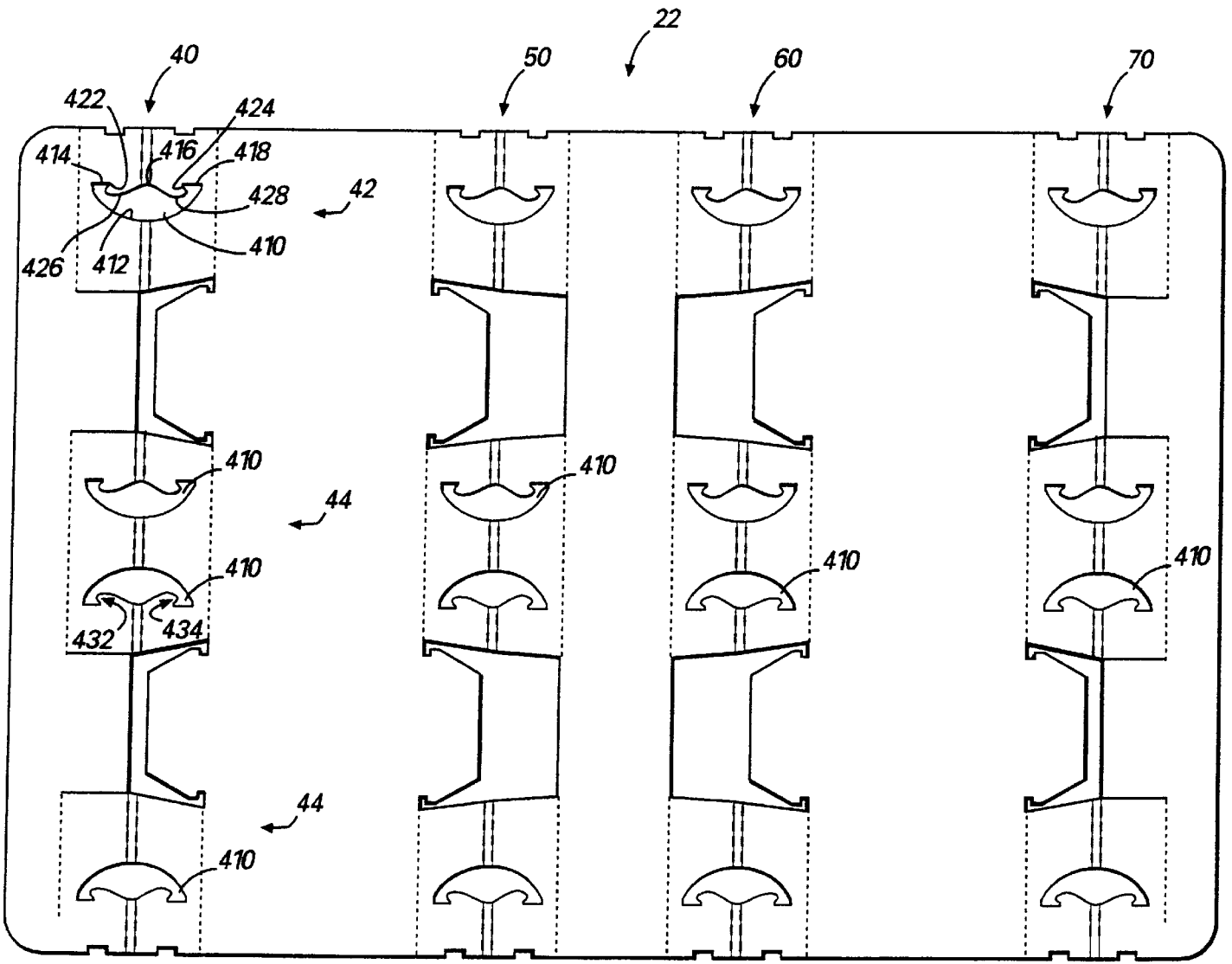
FIG. 11 shows a corrugated paperboard top blank according to another preferred form of the present invention.

Alternatively, the pallet constructed from the bottom blank 20 shown in FIG. 10 would comprise a top blank 22 that differs slightly from the top blank 22 of FIG. 3. This top blank 22 is illustrated in FIG. 11. As shown, the locking slots of first, second, third and fourth top foldable column panels 40, 50, 60, 70 of the top blank 22 comprise identical lock apertures 410. Only the orientation of the lock apertures 410 differ. As described before, both top and bottom blanks 20, 22 preferably are symmetrical about both a vertical and horizontal line of bisection. The orientations ofthe lock apertures 410 flip vertically between different sides of a line of horizontal bisection of top blank 22.

Semicircle side 412, horizontal flat sides 414, 416, 418, vertical flat sides 422, 424 and arcuate sides 426, 428, define lock aperture 410. In a preferred form, the lock aperture 410 is identical about a vertical line of bisection of lock aperture 410. Arcuate sides 426, 428 form notches 432, 434, as shown in column section 44.

When assembly 10 is formed as a pallet, the bottom and top blanks 20, 22 are preferably sized to foldably produce a conventional 40"×48" pallet. In such a configuration, depending on the thickness of corrugated paperboard used, the preferable dimensions of each blank 20, 22 are 40"×77.25" for the bottom blank 20, and 48"×69.25" for the top blank 22. These dimensions provide for a 40"×48" pallet 10 upon folding the blanks 20, 22 and assembling top blank 22 over bottom blank 20 after orientating top blank 22 ninety degrees relative to bottom blank 20, as described under The Assembly Construction.

The number and general shape of each element of the present pallet 10 including the number and shape of column panels, column panel sections, jack passages and the like are variable between alternative embodiments of the present pallet. For example, bottom panel 20 may comprise six column panels. The two column panels beyond the four illustrated in FIG. 2 would be located one between the first and second column panels 40, 50 and one between third and fourth column panels 60, 70. Each would be shaped and orientated as the proximate first and fourth column panel 40, 70, respectively.

The number of locking slots per each bottom and top foldable column panel preferably equals the number of column panels comprising the opposing blank 20, 22. That is, if the top blank 22 comprises eight foldable column panels, then each column panel of the bottom blank 20 has eight locking slots.

Neither edge panels 81, 89 need comprise edge flaps, nor must jack panels 83, 87 of bottom panel 20 have jack passages 126, 128, 176, 178.

The Assembly Construction

The blanks 20, 22 can be foldably constructed to form a load bearing assembly 10, as will now be described in greater detail. FIG. 9 shows the bottom blank 20 of pallet 10 in a partially assembled configuration. Folding of bottom blank 20 will be described from first side 32 to second side 34, although the folding of blank 20 need not follow any particular order.

The first foldable column panel 40 is folded into a rib, rising into a generally perpendicular plane to bottom panel 30, by folding column panel sections 42, 44, 46 upwards from bottom panel 30 about respective score lines 202, 204, 242, 244 and 282, 284. As first foldable column panel 40 begins to take shape as a rib, column top panel 220 of column panel section 42 is folded about score lines 222, 224 and becomes rib top panel 220 that lies in a generally parallel plane to the plane of bottom panel 30. Each column top panel of each panel section 44, 46 is similarly folded.

The column panel 40 continues to fold upward from panel 30 as score lines 202, 242, 282 are brought nearer to score lines 204, 244, 284, respectively. Preferably, each set of score lines abuts one another (for example, score line 202 abuts score line 204), providing column panel 40 with a somewhat triangular appearance since, for example, the width $W_{RTP}$ of rib top panel 220 is preferably greater than twice the thickness of the paperboard blank $T_{PB}$, as shown in FIG. 12.

Figure 12:
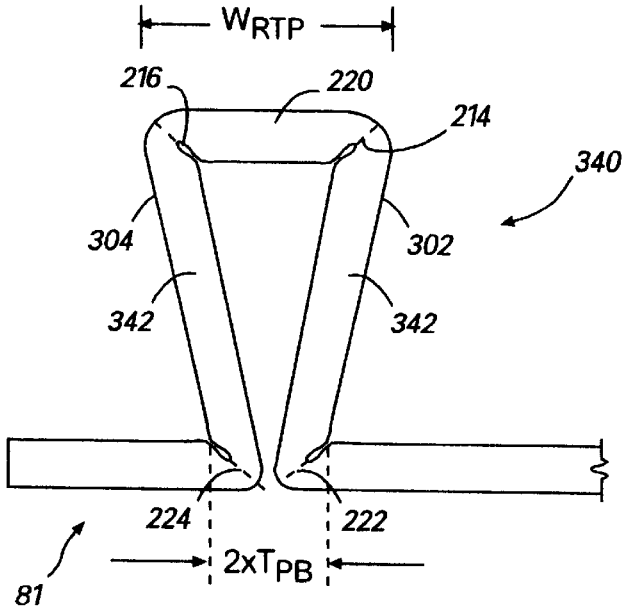
FIG. 12 is a side view of a preferable rib portion of the present invention.

FIG. 12 illustrates a side view of folded rib portion 340, which rib portion 340 is folded panel section 42. Rib portion 340 has side edges 342 of column side panels 302, 304 of the now upwardly extending panels 302, 304. Panel sections 44, 46 similarly form rib portions 340 having side edges.

As rib 40 is folded, jack flaps 122, 124 are necessarily brought toward edge flaps 102, 104, over cutouts 112, 114. Jack flaps 122, 124 preferably are slid over edge flaps 102, 104.

Referring again to FIG. 5, the flap lock assembly 139 has a notch 157 preferably the width of $W_{TAB}$ that is approximately equal to two times the thickness $T_{PB}$ of bottom panel 30. When jack flap 122 foldably slides atop edge flap 102 upon construction of pallet 10, the then upwardly extending side edges 342 of side column panel 302 of column panel section 42 (FIG. 12) first comes into contact with jack flap angled side edges 133, 135 at point p on each flap angled side edge 133, 135. (FIG. 7) Upon pushing head edge 131 further across edge flap 102, the side edge 342 of column side panel 302 of column panel section 42 and flap angled side edges 133, 135 begin to deform until the side edge 342 of column side panel 302 comes to rest in the notches of flap lock assembly 139. At this point, jack flap 122 is in a locked position over edge flap 102. Jack flap 124 is similarly locked thus providing a locked final upstanding rib 350 comprising three rib portions 340 as shown in FIG. 9.

The second column panel 50 is folded into a rib just as column panel 40. Similar to the locking of jack flaps 122, 124 over edge panel 81, middle flaps 142, 144 span across cutouts 132, 134 and fold over jack panel 83. This process it repeated until all the ribs are locked in an upright configuration producing lower frame 12. (FIG. 9)

The top blank 22 of an assembly 10 comprising top blank 22 folds into a locked configuration just as described for bottom blank 20. This locking process is repeated for top blank 22, thus providing the upper frame 14 of assembly 10.

The folded configurations of lower and upper frames 12, 14 are releasably secured against unfolding by the flap lock assemblies. The folded configurations of lower and upper frames 12, 14 can be fixedly secured against unfolding by frame fixed securing means. For example, frame fixed securing means can comprise an adhesive placed on the top faces of edge flaps 102, 104, or the bottom faces ofjack flaps 122, 124, or both, to fixedly secure rib 350 in its folded state by adhesively securing the position of edge flaps 102, 104 over jack flaps 122, 124. Other frame fixed securing means can comprise tape, staples and the like.

The bottom and top blanks 20, 22 of the embodiments illustrated in FIGS. 10 and 11 are similarly folded as described above.

After the bottom and top blanks are folded, the assembly 10 is formed by rotating the bottom or top blank 20, 22 ninety degrees relative to the other blank. Then the top blank 22 is flipped upside down so the ribs 350*t* extend downward toward the upwardly extending ribs 350*b* of bottom blank 20. The blanks 20, 22 are then brought together so the locking slots of each rib on one blank engage the locking slots of ribs of the other blank. As shown in FIG. 1, because the blanks are rotated 90 degrees relative to each other, the upper frame ribs 350*t* and the lower frame ribs 350*b* form crisscrossing rows and columns of ribs.

Figure 13:
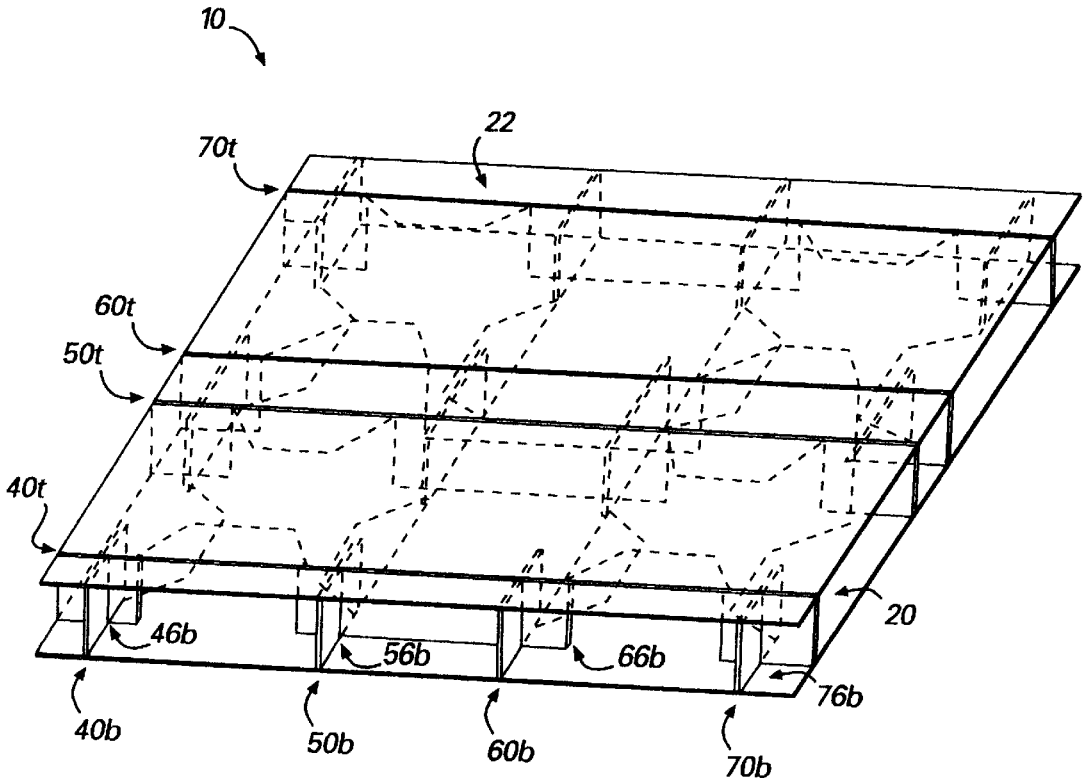
FIG. 13 is a perspective view of an assembled force resisting assembly according to one embodiment of the present invention.

FIG. 13 illustrates a constructed blank or dunnage assembly 10. A rib formed by column panel 40*t* of top panel 42 engages the locking slots of rib portions formed by column panel sections 46*b*, 56*b*, 66*b*, 76*b* of bottom column panels 40*b*, 50*b*, 60*b*, 70*b*, respectively.

The assembled configuration of lower and upper frames 12, 14 is releasably secured against separation by the interconnecting locking slots. The assembled configuration of lower and upper frames 12, 14 can be fixedly secured against separation by assembly fixed securing means. For example, assembly fixed securing means can comprise an adhesive placed on the top surfaces of rib top panels of each panel section, to, for example, fixedly secure each rib top panel of the upper frame 14 to the bottom panel 30 of the lower frame 12. Other assembly fixed securing means can comprise tape, staples and the like.

Figure 14:
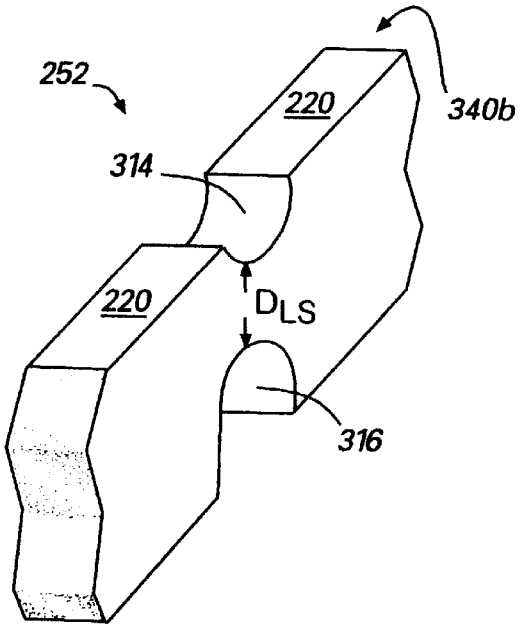
FIG. 14 is a perspective view of a locking slot of a rib portion of the present invention.
Figure 15:
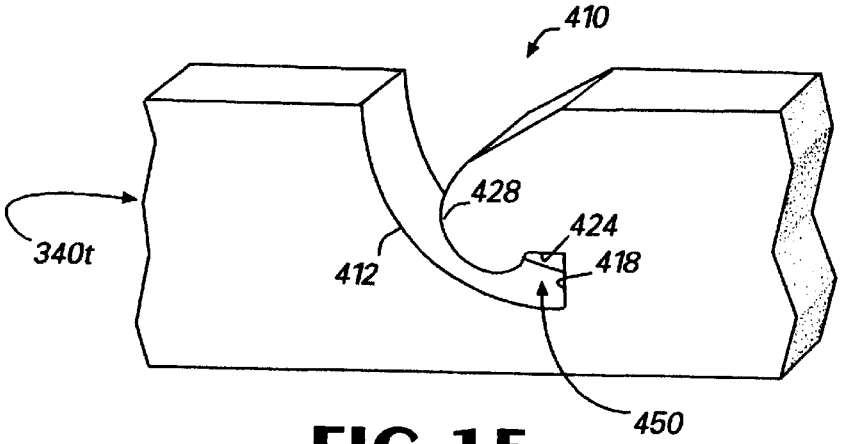
FIG. 15 is a perspective view of a locking slot of another rib portion of the present invention, which rib portion engages the rib portion of FIG. 14 upon construction of the present assembly.
Figure 16:
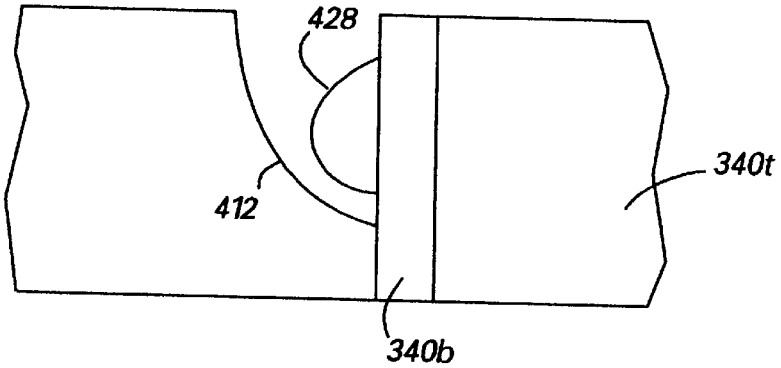
FIG. 16 is a side view of the engagement of the rib portions of FIGS. 14 and 15.

FIGS. 14–16 illustrate the interconnecting locking slots of the assembly 10 constructed from bottom blank 20 of FIG. 10 and top blank 22 of FIG. 11. FIG. 14 shows a rib portion 340*b* of bottom blank 22. Referring to FIGS. 10 and 14, the assembled locking slot 252 comprises locking slot portions 312 (not shown), 314, 316. The distance between the lowest point of slot portion 314 and the highest point of slot portion 316 is designated as $D_{LS}$. FIG. 15 shows a rib portion 340*t* of top blank 20. Referring to FIGS. 11 and 15, the lock aperture 410 comprises semicircle side 412, horizontal flat side 418, vertical flat sides 424 and arcuate side 428. A notch 450 is created by the lock aperture 410. It will be understood that notch 450 in rib portion 340*t* can be formed in a variety of ways, and is shaped to releasably secure rib portion 340*b* within the notch 450. Therefore, notch 450 need not be formed by semicircle 412, or flat portions 418, 424, or arcuate side 428.

Preferably, the length of flat side 418, designated as $D_{LA}$, equals $D_{LS}$. In this manner, when rib portion 340*b* of FIG. 14 is turned upside down and engaged with rib portion 340*t* of FIG. 15, the lock aperture 410 engages the locking slot 252 of rib 340*b*. The solid width of rib portion 340*b* having a height $D_{LS}$ preferably fits snug into notch 450, and is releasably secured within notch 450 by the protruding nose of arcuate side 428 of locking aperture 410, as shown in FIG. 16.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. A force resisting corrugated assembly foldably constructed from a generally flat blank, the blank having top and bottom ends and sides upon folding, said assembly comprising:

(a) first top and bottom jack panels and second top and bottom jack panels, each said top and bottom jack panel being adjacent a respective top and bottom end of the blank;

(b) top and bottom middle panels, each said top and bottom middle panel being adjacent and between respective top and bottom jack panels;

(c) a flap extending from at least one panel of each pair of adjacent jack and middle panels;

(d) a plurality of top and bottom columns, with each column being between adjacent respective top and bottom panels, each said column having locking slots, said top columns being arranged at an angle normal to said bottom columns;

wherein upon folding, said flap of each pair of adjacent panels extending from at least one of adjacent panels engages the other of the adjacent panels, said top and bottom columns extending in a generally normal plane from said respective top and bottom panels, said top and bottom columns forming top and bottom ribs, respectively, each said rib having rib sides with side edges and a top rib panel; and wherein said top and bottom ribs engage each other at locations of said locking slots.

2. The corrugated assembly of claim 1, wherein each said flap is defined by a head edge, angled side edges and at least one lock assembly; and wherein upon folding, said ribs releasably lock in upright configuration by a side edge of at least one rib side engaging said lock assembly of an adjacent flap.

3. A force resisting corrugated assembly foldably constructed from a generally flat blank, the blank having top and bottom ends and sides upon folding, said assembly comprising:

(a) first top and bottom edge panels and second top and bottom edge panels, each said top and bottom edge panel being adjacent a respective top and bottom end of the blank;

(b) first top and bottom jack panels and second top and bottom jack panels, each said top and bottom jack panel being adjacent a respective top and bottom edge panel;

(c) top and bottom middle panels, each said top and bottom middle panel being adjacent and between respective top and bottom jack panels;

(d) a flap extending from at least one panel of each pair of adjacent edge and jack panels, and each pair of adjacent jack and middle panels;

(e) a plurality of top and bottom columns, with each column being between adjacent respective top and bottom panels, each said column having locking slots, said top columns being arranged at an angle normal to said bottom columns;

wherein upon folding, said flap of each pair of adjacent panels extending from at least one of adjacent panels engages the other of the adjacent panels, said top and bottom columns extending in a generally normal plane from said respective top and bottom panels, said top and bottom columns forming top and bottom ribs, respectively, each said rib having rib sides with side edges and a top rib panel; and wherein said top and bottom ribs engage each other at locations of said locking slots.

4. The corrugated assembly of claim 3, wherein the corrugated assembly is coated with a water resistant coating.

5. The corrugated assembly of claim 4, wherein said water resistant coating is a water-dispersible polymer suspension.

6. The corrugated assembly of claim 3, wherein there are at least two top rib sections for each top rib, separated from one another by cutouts in the blank, and wherein there are at least two bottom rib sections for each bottom rib, separated from one another by cutouts in the blank.

7. The corrugated assembly of claim 6, wherein at least one rib section of a rib is further separated from another rib section of the same rib by said flap extending from at least one of adjacent panels.

8. The corrugated assembly of claim 7, wherein said rib sections of said top and bottom ribs are of substantially the same width.

9. The corrugated assembly of claim 8, wherein each flap extending from at least one of adjacent panels are substantially the same shape, each said flap being defined by a head edge, angled side edges and at least one lock assembly; and wherein upon folding, said ribs releasably lock in upright configuration by a side edge of at least one rib side engaging said lock assembly of an adjacent flap.

10. The corrugated assembly of claim 9, wherein each said lock assembly of each said flap comprises a lock tab and a notch formed in each angled side edge away from said head edge;

wherein upon folding, said lock tab of each said lock assembly slidably contacts the side edge of at least one rib side of at least one rib section of a rib, then passes said side edge whereupon said side edge slides into said notch of said lock assembly of said flap.

11. A force resisting corrugated assembly foldably constructed from a generally flat top and bottom blank, the top and bottom blanks having ends and sides, said assembly comprising:

(a) first top and bottom edge panels and second top and bottom edge panels, each said edge panel being adjacent a respective end of the blank, each said edge panel having at least one edge flap, each said edge flap directed inwardly from a respective end of the blank;

(b) first top and bottom jack panels and second top and bottom jack panels, each said jack panel being adjacent a respective edge panel, each said jack panel having at least one jack flap, each said jack flap being adjacent a respective edge panel;

(c) top and bottom middle panels, each said middle panel being between respective jack panels, each said middle panel having at least one middle flap adjacent each respective jack panel;

(d) a plurality of top and bottom columns, with each column being between adjacent respective top and bottom panels, each said column having locking slots, said top columns being arranged at an angle normal to said bottom columns;

each said top and bottom column panel incorporating a plurality of column panel sections, each said column panel section having at least one said locking slot, said column panel sections separated from one another by cutouts in the blank;

said jack flaps and said middle flaps each being defined by a head edge, angled side edges and at least one lock assembly;

wherein upon folding, said jack flaps engage respective edge panels and said middle flaps engage respective jack panels, said top and bottom columns extending in a generally normal plane from said respective top and bottom panels, said top and bottom columns forming top and bottom ribs, respectively, each said rib having rib sides with side edges and a top rib panel;

wherein said flaps are secured to respective panels by a first securing means;

wherein said top and bottom ribs engage each other at locations of said locking slots; and wherein said top and bottom ribs are secured to each other by a second securing means.

12. The corrugated assembly of claim 11, wherein each bottom jack panel has at least one aperture for allowing insertion of a jack head for lifting the assembly and any load thereon.

13. The corrugated assembly of claim 11, wherein the first securing means comprises adhesively securing one or more said flaps to the respective engaged panels.

14. The corrugated assembly of claim 11, wherein the second securing means comprises adhesively securing said top ribs to the bottom panels and the bottom ribs to the top panels.

15. The corrugated assembly of claim 11, wherein the corrugated assembly is coated with a water resistant coating.

16. The corrugated assembly of claim 15, wherein said water resistant coating is a water-dispersible polymer suspension.

17. The corrugated assembly of claim 11, wherein each said lock assembly of said jack and middle flaps comprises a lock tab and a notch formed in each angled side edge away from said head edge;

wherein upon folding, said lock tabs of said jack and middle flaps slidably contact the side edge of at least one rib side of each said rib section, then pass said side edge whereupon said edge slides into said notch of said lock assembly of said jack and middle flaps.

18. A method of fabricating a force resisting corrugated assembly foldably constructed from at least one generally flat blank having ends and sides, the blank further including first top and bottom edge panels and second top and bottom edge panels, each said edge panel being adjacent a respective end of the blank, first top and bottom jack panels and second top and bottom jack panels, each said jack panel being adjacent a respective edge panel, each said jack panel having at least one jack flap, each said jack flap being adjacent a respective edge panel, top and bottom middle panels, each said middle panel being between respective jack panels, each said middle panel having at least one middle flap adjacent each respective jack panel, said jack flaps and said middle flaps each being defined by a head edge, angled side edges and at least one lock assembly, and a plurality of top and bottom columns, with each column being between each adjacent respective top and bottom panels, with each column being between adjacent respective top and bottom panels, each said column having locking slots, said top columns being arranged at an angle normal to said bottom columns:

(a) engaging said jack flaps with respective edge panels and engaging said middle flaps with respective jack panels, said top and bottom columns extending in a generally normal plane from said respective top and bottom panels, said top and bottom columns forming top and bottom ribs, respectively, each said rib forming at least two rib section separated from one another by cutouts in the at least one blank, said rib sections having rib sides with side edges and a top rib panel;

(b) releasably locking said rib sections in upright configurations by a side edge of at least one rib side engaging said lock assembly of an adjacent flap; and (c) placing said top rib sections over said bottom rib sections wherein said top and bottom rib sections engage each other at locations of said locking slots.

19. The method of claim 18, wherein each said lock assembly comprises a lock tab and a notch formed in each angled side edge away from said head edge, and wherein the step (b) of releasably locking said rib sections further comprises folding said rib sections so the said lock tab of each said lock assembly slidably contacts the side edge of at least one rib side of at least one rib section of a rib, then passes said side edge whereupon said side edge slides into said notch of said lock assembly of said jack and middle flaps.

20. A lock assembly to lock the orientation of an upwardly extending rib foldably constructed from a flat column of a blank, said lock assembly comprising first and second panels on either side of the flat column, and a flap extending from one of said first or second panels, wherein said flap incorporates a lock tab and a notch, wherein upon folding said first and second panels toward each other, the column folds into the upwardly extending rib, the rib having rib sides with side edges, wherein said lock tab of said flap slidably contacts a side edge of one rib side, then passes said side edge whereupon said edge slides into said notch of said lock assembly of said flap.

* * * * *

UNITED STATES PATENT AND TRADEMARK OFFICE

CERTIFICATE OF CORRECTION

PATENT NO. : 6,029,582
DATED : February 29, 2000
INVENTOR(S) : Morgan O. Ogilvile It is certified that error appears in the above-identified patent and that said Letters Patent is hereby corrected as shown below:

Title page,
Item [76], Inventors, should read -- Michael W. Olvey, Fairburn, Ga., Morgan O. Ogilvie, Jr., Birmington, Ala, Paul M. Whatley, Birmingham, Ala. --

Signed and Sealed this

Eleventh Day of May, 2004

JON W. DUDAS
*Acting Director of the United States Patent and Trademark Office*